US011622585B1

(12) United States Patent
Skeath

(10) Patent No.: US 11,622,585 B1
(45) Date of Patent: Apr. 11, 2023

(54) FASTENER-FREE SWADDLE WRAP AND GARMENTS

(71) Applicant: Mama Coco LLC, Manhattan Beach, CA (US)

(72) Inventor: Megan Dorrian Skeath, Hermosa Beach, CA (US)

(73) Assignee: Mama Coco LLC, Manhattan Beach, CA (US)

( * ) Notice: Subject to any disclaimer, the term of this patent is extended or adjusted under 35 U.S.C. 154(b) by 300 days.

(21) Appl. No.: 16/849,849

(22) Filed: Apr. 15, 2020

(51) Int. Cl.
*A41B 13/06* (2006.01)
*A47G 9/08* (2006.01)
*A41D 1/21* (2018.01)

(52) U.S. Cl.
CPC ..... *A41B 13/06* (2013.01); *A47G 9/083* (2013.01); *A41B 2300/30* (2013.01); *A41D 1/21* (2018.01); *A41D 2400/482* (2013.01)

(58) Field of Classification Search
CPC ..... A41B 13/06; A41B 2300/32; Y10S 5/922; Y10S 5/923; A47G 9/083; A41D 1/21; A41D 2400/482
See application file for complete search history.

(56) References Cited

U.S. PATENT DOCUMENTS 5,129,406 A 7/1992 Magnusen et al.
5,535,449 A 7/1996 Dickey
D400,688 S 11/1998 Federspiel
6,662,390 B1 * 12/2003 Berger ..... A41B 13/06 5/655
6,868,566 B2 3/2005 Gatten
6,928,674 B2 8/2005 Blackburn
7,076,819 B2 * 7/2006 Trani ..... A41B 13/06 2/69.5
7,181,789 B2 2/2007 Gatten
(Continued)

FOREIGN PATENT DOCUMENTS

DE 202011004399 6/2011
GB 2557315 6/2018

OTHER PUBLICATIONS

Swado, 8 pages, dated as available at https://swado.co/ on Apr. 1, 2020 by the Wayback Machine internet archive (accessed and printed on Aug. 5, 2020).

(Continued)

*Primary Examiner* — David R Hare
*Assistant Examiner* — Madison Emanski
(74) *Attorney, Agent, or Firm* — Knobbe Martens Olson and Bear, LLP

(57) ABSTRACT

Disclosed are embodiments of a swaddle wrap that can, in some embodiments, include a first portion having a backing layer, a front layer, and a first enclosure between the backing layer and the front layer, and a second portion coupled with the first portion, the second portion having a backing layer, a front layer, and a second enclosure between the backing layer and the front layer of the second portion. In some embodiments, the swaddle wrap can be configured to be moved from a first state to a second state, the first enclosure can be configured to receive therein at least both feet of a baby in the second state, and the second enclosure can be configured to receive therein at least both feet of the baby in the second state to secure the swaddle wrap to the baby without the use of any fasteners or ties.

30 Claims, 17 Drawing Sheets

(56) References Cited

U.S. PATENT DOCUMENTS

| | | | | |
|---|---|---|---|---|
| 7,254,849 | B1 | 8/2007 | Fiebrich et al. | |
| 7,681,261 | B1 | 3/2010 | O'Neill | |
| D613,106 | S | 4/2010 | Ward et al. | |
| D618,883 | S | 7/2010 | Nelson | |
| 7,774,875 | B1 | 8/2010 | Zeldman | |
| 8,191,188 | B2 | 6/2012 | Kaplan et al. | |
| 8,347,432 | B2 | 1/2013 | Schmid et al. | |
| 8,365,325 | B2 | 2/2013 | Schneider | |
| 8,375,486 | B2 | 2/2013 | Earnest | |
| 8,539,620 | B1 | 9/2013 | Wynh | |
| 8,650,685 | B1 | 2/2014 | Ford | |
| 8,726,437 | B2 | 5/2014 | Hardesty | |
| 8,745,794 | B1 | 6/2014 | McDermott | |
| D715,518 | S | 10/2014 | Daugherty et al. | |
| 9,119,423 | B2 | 9/2015 | Gotel et al. | |
| 9,131,734 | B2 | 9/2015 | Daugherty et al. | |
| D751,270 | S | 3/2016 | White | |
| 9,572,376 | B2 | 2/2017 | Gangan et al. | |
| D790,803 | S | 7/2017 | Paperno | |
| 10,165,802 | B2 | 1/2019 | Clouse et al. | |
| 10,709,174 | B2 * | 7/2020 | Stephan | A41B 13/06 |
| 2006/0010600 | A1 | 1/2006 | Kendy | |
| 2010/0299801 | A1 | 12/2010 | Nilsson | |
| 2012/0216349 | A1 | 8/2012 | Kaplan et al. | |
| 2012/0311762 | A1 | 12/2012 | Aiken et al. | |
| 2014/0020176 | A1 | 1/2014 | Coates | |
| 2014/0352167 | A1 | 12/2014 | Peters | |
| 2015/0101101 | A1 | 4/2015 | Gotel et al. | |
| 2016/0157642 | A1 | 6/2016 | Xiong | |
| 2016/0174619 | A1 | 6/2016 | Waters et al. | |
| 2017/0280784 | A1 * | 10/2017 | Spencer | A41B 13/06 |
| 2017/0318984 | A1 | 11/2017 | Parker | |
| 2018/0271178 | A1 | 9/2018 | Villarreal | |
| 2019/0125005 | A1 | 5/2019 | Giveans | |
| 2019/0239573 | A1 | 8/2019 | Mercy | |
| 2019/0261703 | A1 * | 8/2019 | Zodel | A41D 1/21 |
| 2020/0323288 | A1 * | 10/2020 | Severson | A41B 13/06 |

OTHER PUBLICATIONS

A Star Is Born Modal Magnetic Sack Gown & Hat Set—Magnetic Me, (https://magneticme.com/products/a-star-is-born-modal-magnetic-sack-gown-hat-set) in 7 pages (believed to have published prior to Apr. 15, 2020).

SwaddleMe Original Swaddle, (https://www.amazon.com/SwaddleMe-Original-Swaddle-3-PK-Safari/dp/B01644OV1O/?tag=dotdashvwfm-20) in 10 pages (believed to have published prior to Apr. 15, 2020).

Sleepea Swaddle—Happiest Baby, (https://www.happiestbaby.com/products/sleepea-swaddle?variant=1552425910297&utm_medium=cpc&utm_source=google&utm_campaign=Google%20Shopping&gclid=CjwKCAiA4Y7yBRB8EiwADV1haV6lJudn8fg-kTYL5ErJQj1zV8ouDoOmAGYk4tDSgKVbwrniLqT5lhBoCPOgQAvD_BwE) in 13 pages (believed to have published prior to Apr. 15, 2020).

SwaddleMe Pod, (https://www.amazon.com/SwaddleMe-Pod-2-PK-PeaPods-NB/dp/B01416HEHA/?tag=dotdashvwfm-20) in 9 pages (believed to have published prior to Apr. 15, 2020).

Nested Bean Zen Swaddle Classic™, (https://www.buybuybaby.com/store/product/nested-bean-zen-swaddle-classic-trade-in-powder-blue/1043616275?keyword=infant-cozy-bear-swaddle) in 3 pages (believed to have published prior to Apr. 15, 2020).

Nested Bean® Zen One™ Classic Swaddle, (https://www.buybuybaby.com/store/product/nested-bean-reg-zen-one-trade-classic-swaddle-in-sand/5454857?skuid=69491426&rnrkgcl=611&mrkgadid=3339063918&mcid=PS_googlepla_nonbrand_clothing_local&product_id=69491426&product_channel=local&adtype=pla&enginename=google&adpos=1o10&creative=263168672551&device=c&matchtype=&network=g&utm_campaignid=71700000040071052&utm_adgroupid=58700004308586921&targetid=92700043916498414&gclid=CjwKCAIA4Y7yBRB8EiwADV1haeZtjO_aF15suRe8M7pX1tQBRXgTjH2j7HQ-16sULtmGN1Q-zquqehoCJDMQAvD_BwE&gcisrc=aw.ds) in 3 pages (believed to have published prior to Apr. 15, 2020).

OETEO Innovations, (https://www.oeteo.co/innovations/) in 7 pages (believed to have published prior to Apr. 15, 2020).

Luxe Waffle Sweet Baby B Romper—Monica + Andy, (https://monicaandandy.com/products/luxe-waffle-sweet-baby-b-romper?variant=32190376575038&currency=USD&utm_source=google&utm_medium=cpc&utm_term=&matchtype=&adposition=&utm_content=359473107763&ntwrk=search&plcmnt=utm_device=c&utm_campaign=(adqroupid%7D&gclid=CjwKCAiA4Y7yBRB8EiwADV1haSt3m3C3VjdvW0pOxjNrskp1kDmODOMCbJEfJKDNVg7ggMjSeuPSKxoC6voQAvD_BwE) in 4 pages (believed to have published prior to Apr. 15, 2020).

Newborn Baby Sleeper Gown—100% Organic Cotton | Colored Organics®, (https://coloredorganics.com/products/organic-unisex-infant-gown-52301-19?variant=19877536268384&currency=USD&utm_campaign=gs-2019-06-27&utm_source=goggle&utm_medium=smart_campaign&gclid=CjwKCAiA4Y7yBRB8EiwADV1haQaF6GUtiTd2pnTvg5PT0NOjOroAeVxgKrHBTn4Kow6tZmtoROWhuhoCrhoQAvD_BwE) in 5 pages (believed to have published prior to Apr. 15, 2020).

A Star Is Born Modal Magnetic Coverall—Magnetic Me, (https://magneticme.com/products/a-star-is-born-modal-magnetic-coverall) in 7 pages (believed to have published prior to Apr. 15, 2020).

Hello Baby Top—Monica + Andy, (https://monicaandandy.com/products/hello-baby-top?variant=2360000184346&currency=USD&utm_source=google&utm_medium-cpc&utm_term=&matchtype=&adposition=&utm_content=300712578473&ntwrk=search&plcmnt=&utm_device=c&utm_campaign=(adgroupid%7D&gclid=CjwKCAiA4Y7yBRB8EiwADV1hac6_UcmogLqxEWu1PxxYqJ5TUxXW11H_M5Gs481kxvbfM8FZ8FfgOBoCtYUQAvD_BwE) in 6 pages (believed to have published prior to Apr. 15, 2020).

Blue Carnivale Modal Magnetic 3-Piece Kimono Set—Magnetic Me, (https://magneticme.com/products/blue-carnivale-modal-magnetic-3-piece-kimono-set) in 6 pages (believed to have published prior to Apr. 15, 2020).

Kimono Top, Maisonette, (https://www.maisonette.com/product/kimono-top-vanilla?gclid=CjwKCAlA4Y7vBRB8EjwADV1hadjNqNwlW_1B7d4aBEf-iiONNN05mFUytCk6UFW26kyE-QHdlVw2Nhoc_boQAvD_BwE) in 4 pages (believed to have published prior to Apr. 15, 2020).

* cited by examiner

FASTENER-FREE SWADDLE WRAP AND GARMENTS

BACKGROUND OF THE DISCLOSURE

Field of the Disclosure

Embodiments of the present disclosure relate to apparatuses and methods for covering a baby with a wrap, to bodysuit and upper body garments and methods for dressing a person with such garments.

Background and Description of the Related Art

Swaddling blankets can be used to help babies feel safe, secure and to help babies sleep better by mimicking the confined environment inside the womb, therefore reducing the mono "startle" reflex while also providing the baby with warmth and protection. However, available swaddling blankets can be cumbersome, particularly those with buttons, snaps, zippers, hook and loop fasteners, magnets, or other fasteners, and can be ineffective in keeping the baby wrapped and comfortably sleeping. There is a need for an easy to use, fastener-free, more reliable swaddling blanket.

Additionally, for available swaddling blankets with hook and loop fasteners, it can be difficult to align the corresponding hook and loop fasteners, patches with the appropriate fit and size of baby in order to keep baby in a comfortable position. In addition, removing hook and loop fasteners in order to change a soiled diaper while baby is sleeping will likely wake baby, disrupting sleep, thereby defeating a key purpose of the swaddle. Also, available swaddles with zippers have an inherent risk of zipping baby's precious skin. In addition, hook and loop fasteners and zippers can often be noisy, disturbing the baby while sleeping. As for available swaddles with snaps and buttons, it can be very cumbersome to align corresponding snaps/buttons, often resulting in misalignment, making swaddling an unnecessarily longer and more tedious process. The available swaddles with magnetic fasteners or a knotted fabric fastener are less effective in keeping baby in a securely compact womb-like position.

Dresses, onesies, bodysuits and other garments are typically applied to babies or small children by passing the dress, onesie and/or other garment over the baby's or child's head. This can be unnerving to the boy or girl being dressed and can be difficult to do. Other garments, particularly those with buttons, zippers, snaps or other fasteners, can be cumbersome, difficult, and time consuming to dress the baby or child with. The traditional baby onesie requires pulling the garment over the baby's head in order to appropriately dress and fit the baby's arms and legs through the respective holes. This is often upsetting to infants causing unnecessary distress and prolonging the time needed to dress the baby. Many available onesies or bodysuits also require snaps, buttons, ties, hook and loop fasteners and/or other fasteners to secure the garment to the baby, which can be very cumbersome and can often result in misalignment of fasteners, making dressing an unnecessarily longer and more tedious process. Additionally, available onesies with zippers have an inherent risk of zipping baby's precious skin. In addition, available onesies with hook and loop fasteners and/or zippers can often be noisy, unnecessarily disturbing a relaxed or sleeping baby during the changing/dressing process.

Tops such as t-shirts and other upper body garments are typically designed to be passed over the heads of babies to clothe the baby. This can be unnerving to the baby and can be difficult to do. Other garments that use fasteners to avoid having to pass the garment over the head of the baby, particularly those with buttons, snaps, zippers, ties, hook and loop fasteners, magnets or other fasteners, and can be cumbersome, difficult, and time consuming to dress the person with.

Current available tops with no fasteners require pulling the material over the baby's head which usually causes unnecessary distress since babies typically do not like this sensation. Tops incorporating zippers to expand the head opening still typically require pulling the garment over the baby's head which can be unnerving in addition to presenting a risk of zipping the baby's precious skin. Tops incorporating buttons, snaps, ties, magnets and/or hook and loop fasteners to expand the head opening can make the dressing process longer than necessary in order to align and fasten corresponding fasteners and may also still require pulling fabric over the baby's or person's head which can be uncomfortable for baby or person. Any of the conventional tops with fasteners may also require picking up baby in order to secure the garment to baby which adds to the unnecessary time and effort required to secure such garments.

SUMMARY OF SOME EXEMPLIFYING EMBODIMENTS

The systems, methods and apparatuses of this disclosure each have several innovative aspects, implementations, or aspects, no single one of which is solely responsible for the desirable attributes disclosed herein. Some embodiments of the swaddle wraps disclosed herein can include a first portion having a backing layer, a front layer, and a first enclosure between the backing layer and the front layer, and a second portion coupled with the first portion, the second portion having a backing layer, a front layer, and a second enclosure between the backing layer and the front layer of the second portion. In some embodiments, the swaddle wrap can be configured to be moved from a first state to a second state, the first enclosure can be configured to receive therein at least both feet of a baby in the second state, and the second enclosure can be configured to receive therein at least both feet of the baby in the second state to secure the swaddle wrap to the baby without the use of any fasteners or ties.

Some embodiments of the swaddle wraps disclosed herein can include a first portion having a backing layer, a front layer, and a first enclosure between the backing layer and the front layer, and a second portion coupled with the first portion, the second portion having a backing layer, a front layer, and a second enclosure between the backing layer and the front layer of the second portion. In some embodiments, the first enclosure can be configured to secure the entire first portion to the baby when at least a first shoulder and the feet of the baby are in the first enclosure, the second enclosure can be configured to secure the entire second portion to the baby when the second enclosure covers at least a second shoulder of the baby and at least the feet of the baby are in the second enclosure, and/or the second enclosure can be configured to cover the feet of the baby after the first enclosure has covered the feet of the baby.

Any of the embodiments of the swaddle wraps or methods of securing a swaddle wrap to a baby disclosed herein can include, in additional embodiments, one or more of the following features, components, steps, and/or details in any combination with any of the other features, components, and/or details of any other embodiments disclosed herein: wherein the second portion is configured to extend around at least the baby's feet in the second state to secure the swaddle wrap to the baby's body; and/or wherein the second portion is configured to be extended around at least one of the baby's shoulders and both feet of the baby to secure the swaddle wrap to the baby's body.

Face in Opposite Directions:

Any of the embodiments of the swaddle wraps or methods of securing a swaddle wrap to a baby disclosed herein can include, in additional embodiments, one or more of the following features, components, steps, and/or details in any combination with any of the other features, components, and/or details of any other embodiments disclosed herein: wherein the first enclosure and the second enclosure face in opposite directions in the second state; and/or wherein the opening of the first portion faces the opening of the second portion in the second state.

Shoulder Coverage:

Any of the embodiments of the swaddle wraps or methods of securing a swaddle wrap to a baby disclosed herein can include, in additional embodiments, one or more of the following features, components, steps, and/or details in any combination with any of the other features, components, and/or details of any other embodiments disclosed herein: wherein the first portion is configured to cover a first shoulder of the baby when the baby is in the first enclosure in the second state so that a portion of the first portion is positioned over the top of and around the baby's first shoulder in the second state; wherein the first portion is configured to not cover a second shoulder of the baby when the baby is in the first enclosure in the second state; and/or wherein the second portion is configured to cover a second shoulder of the baby in the second state so that a portion of the second portion is positioned over the top of the baby's second shoulder and around the baby's second shoulder in the second state; and/or wherein the swaddle wrap is configured such that no portion of the swaddle wrap goes over the baby's head during the process of covering the baby with the swaddle wrap.

Backing Layer:

Any of the embodiments of the swaddle wraps or methods of securing a swaddle wrap to a baby disclosed herein can include, in additional embodiments, one or more of the following features, components, steps, and/or details in any combination with any of the other features, components, and/or details of any other embodiments disclosed herein: wherein the backing layer of the second portion is configured to cover a substantial portion of the front layer of the first portion in the second state; wherein the backing layer of the second portion is configured to cover a majority of the front layer of the first portion in the second state; wherein the backing layer of the second portion is configured to cover at least 75% of the front layer of the first portion in the second state; wherein the backing layer of the second portion is configured to directly contact and overlap at least a portion of the first portion; wherein the front layer of the second portion is configured to cover a portion of the backing layer of the first portion in the second state; wherein the first portion and the second portion form a crisscross pattern over a front of the baby's body in the second state; wherein the first portion is configured to completely cover a first arm, both legs, and both feet of the baby, and the second portion is configured completely cover a second arm, both legs, and both feet of the baby in the second state; wherein both the first portion and the second portion are configured to receive and at least partially cover at least the baby's legs and feet in the second state; wherein the backing layer of the second portion is configured to extend over a front of the baby's body in the second state; and/or wherein the second portion is configured to move from a first position in the first state in which the backing layer of the second portion is in the same plane as the backing layer of the first portion to a second position in the second state in which the backing layer crosses across the baby's body and the front layer of the second portion is in contact with the backing layer of the first portion Seam:

Any of the embodiments of the swaddle wraps or methods of securing a swaddle wrap to a baby disclosed herein can include, in additional embodiments, one or more of the following features, components, steps, and/or details in any combination with any of the other features, components, and/or details of any other embodiments disclosed herein: wherein the first portion is connected to the second portion along a seam; wherein the seam directly connects the backing layer of the first portion with the backing layer of the second portion; wherein a connecting portion between the backing layer of the first portion and the backing layer of the second portion is adjacent to a shoulder and upper arm portion of the baby when the baby is positioned in the first portion; and/or wherein the first portion and the second portion are made from a single and/or continuous piece of fabric or other material so that there is no seam between the first portion and the second portion, in either or both of the front layer and/or the backing layer.

Enclosures and Front Cover:

Any of the embodiments of the swaddle wraps or methods of securing a swaddle wrap to a baby disclosed herein can include, in additional embodiments, one or more of the following features, components, steps, and/or details in any combination with any of the other features, components, and/or details of any other embodiments disclosed herein: wherein the first portion only has one opening therein; wherein the second portion only has one opening therein; and/or wherein the second enclosure is configured to also receive therein a portion of the first portion of the swaddle wrap in the second state.

No Zippers, Knots, or Other Fasteners:

Any of the embodiments of the swaddle wraps or methods of securing a swaddle wrap to a baby disclosed herein can include, in additional embodiments, one or more of the following features, components, steps, and/or details in any combination with any of the other features, components, and/or details of any other embodiments disclosed herein: wherein the swaddle wrap is configured to be secured to the baby without a use of zippers, snaps, ties, hook and loop fasteners, buttons, knots, magnets, or other connectors or fasteners other than the first and second enclosures; and/or wherein the swaddle wrap comprises only the first portion and the second portion; and/or wherein the swaddle wrap is configured to be secured to the baby's body using only the first enclosure and the second enclosure Shape:

Any of the embodiments of the swaddle wraps or methods of securing a swaddle wrap to a baby disclosed herein can include, in additional embodiments, one or more of the following features, components, steps, and/or details in any combination with any of the other features, components, and/or details of any other embodiments disclosed herein: wherein the second portion is sized and configured such that, when a baby is positioned in the swaddle wrap in the second state, the second portion covers a first one of the baby's shoulders but not a second one of the baby's shoulders; wherein the second portion is sized, positioned, and connected to the first portion such that, when a baby is positioned in the swaddle wrap in the second state, the second portion covers a first one of the baby's shoulders but not a second one of the baby's shoulders; wherein the first enclosure is configured to cover the baby's first shoulder but not the baby's second shoulder, and the second opening is configured to cover the baby's second shoulder but not the baby's first shoulder; wherein the first portion and the second portion both have a curved bottom edge; wherein at least one of the first portion and the second portion comprises a enclosure; wherein an opening of the enclosure in the first portion of the swaddle wrap is at an angle such that, when a baby is positioned in the swaddle wrap in the second state, the front layer covers only one of the baby's shoulders; wherein the front layer of the first portion of the swaddle wrap is shaped and configured such that, when a baby is positioned in the swaddle wrap in the second state, the front layer covers only one of the baby's shoulders; wherein, when the swaddle wrap is in the first state before being used to cover the baby, no portion of the second portion covers any portion of the first portion; wherein, when the swaddle wrap is in the first state before being used to cover the baby, the second portion is positioned to a side of the first portion; wherein no portion of the front layer of the second portion is directly attached to any part of the first portion; wherein, when the swaddle wrap is positioned on a flat surface in a relaxed state before being used to cover the baby and the first portion is positioned at an approximately 6 o'clock position with the front layer facing away from the flat surface, the second portion will be positioned at an approximately 8 o'clock position; and/or wherein, when the swaddle wrap is positioned on a flat surface in a relaxed state before being used to cover the baby and the first portion is positioned at an approximately 6 o'clock position with the front layer facing away from the flat surface, the second portion will be positioned between and including an approximately 7 o'clock position and an approximately 10 o'clock position Number of Steps:

Any of the embodiments of the swaddle wraps or methods of securing a swaddle wrap to a baby disclosed herein can include, in additional embodiments, one or more of the following features, components, steps, and/or details in any combination with any of the other features, components, and/or details of any other embodiments disclosed herein: wherein the swaddle wrap is configured to change from the first state in which no portion of the baby's body is covered by the swaddle wrap to the second state in which the baby's body from at least the arms down is completely covered by the swaddle wrap and the swaddle wrap is secured to the baby's body in only two steps; wherein a first step of the two steps comprises positioning the baby in the first enclosure so that at least both of the baby's feet and one of the baby's shoulders are in the first enclosure; wherein a second step of the two steps comprises positioning the second portion over at least a portion of the baby so that at least both of the baby's feet and one of the baby's shoulders are in the second enclosure; wherein the swaddle wrap is configured to change from the first state in which no portion of the baby's body is covered by the swaddle wrap to the second state in which the baby's body from at least the shoulders down is completely covered by the swaddle wrap and the swaddle wrap is secured to the baby's body in only two steps; wherein the swaddle wrap is configured so that a user can completely cover the baby from at least the shoulders down and selectively secure the swaddle wrap to the in only two steps; wherein a first step of the two steps comprises positioning the baby in the first enclosure so that at least both of the baby's feet and one of the baby's shoulders are in the first enclosure; wherein a second step of the two steps comprises positioning the second portion over at least a portion of the baby so that at least both of the baby's feet and one of the baby's shoulders are in the second enclosure; and/or further comprising a third portion coupled with the first portion.

Third Pocket:

Some embodiments of the swaddle wraps disclosed herein can include a first portion having a backing layer, a second portion coupled with the first portion, the second portion having a backing layer, a front layer, and a second enclosure between the backing layer and the front layer of the second portion, and a third portion coupled with the first portion, the third portion having a backing layer, a front layer, and a third enclosure between the backing layer and the front layer of the third portion. Any of the embodiments of the swaddle wraps or methods of securing a swaddle wrap to a baby disclosed herein can include, in additional embodiments, one or more of the following features, components, steps, and/or details in any combination with any of the other features, components, and/or details of any other embodiments disclosed herein: wherein the swaddle wrap is configured to be moved from a first state wherein the swaddle wrap is not secured to the baby to a second state wherein the first portion, the second portion, and the third portion are secured to the baby, the second enclosure is configured to cover at least both feet of the baby in the second state, and the third enclosure is also configured to cover at least both feet of the baby in the second state.

Any of the embodiments of the swaddle wraps or methods of securing a swaddle wrap to a baby disclosed herein can include, in additional embodiments, one or more of the following features, components, steps, and/or details in any combination with any of the other features, components, and/or details of any other embodiments disclosed herein: wherein the first portion comprises a front layer, and a first enclosure between the backing layer and the front layer, wherein the first enclosure is configured to cover at least both feet of a baby in the second state; wherein the second portion is configured to extend around at least the feet of the baby in the second state to secure the swaddle wrap to the baby's body in the second state; wherein the second portion is configured to extend around at least one of the baby's shoulders and the baby's feet in the second state to secure at least the second portion to the baby's body; wherein the third portion is configured to extend around at least the feet of the baby in the second state to secure the third portion to the baby's body in the second state; and/or wherein the third portion is configured to extend around at least one of the baby's shoulders and the baby's feet in the second state to secure at least the third portion to the baby's body. In any embodiments disclosed herein, the first portion can be made without an enclosure (also referred to herein as a pouch). Further, in any embodiments disclosed herein, the swaddle wrap can be configured such that the second portion encloses a portion of first portion.

Shoulder Coverage:

Any of the embodiments of the swaddle wraps or methods of securing a swaddle wrap to a baby disclosed herein can include, in additional embodiments, one or more of the following features, components, steps, and/or details in any combination with any of the other features, components, and/or details of any other embodiments disclosed herein: wherein the second portion is configured to cover a first shoulder but not a second shoulder of the baby when the second portion is in the second state and the third portion is configured to cover the second shoulder but not the first shoulder of the baby when the third portion is in the second state; wherein the first portion is configured to not cover either the first shoulder or the second shoulder of the baby in the second state; wherein the second portion is configured to cover a second shoulder of the baby in the second state so that a portion of the second portion is positioned over the top of the baby's second shoulder and around the baby's second shoulder in the second state; and/or wherein the swaddle wrap is configured such that no portion of the swaddle wrap goes over the baby's head during the process of covering the baby with the swaddle wrap Backing Layer:

Any of the embodiments of the swaddle wraps or methods of securing a swaddle wrap to a baby disclosed herein can include, in additional embodiments, one or more of the following features, components, steps, and/or details in any combination with any of the other features, components, and/or details of any other embodiments disclosed herein: wherein the backing layer of the second portion is configured to cover a substantial portion of the front layer of the first portion in the second state; wherein the backing layer of the second portion is configured to cover a majority of the front layer of the first portion in the second state; wherein the backing layer of the second portion is configured to cover at least 75% of the front layer of the first portion in the second state; wherein the backing layer of the second portion is configured to directly contact and overlap at least a portion of the first portion; wherein the front layer of the second portion is configured to cover a portion of the backing layer of the first portion in the second state; wherein the front layer of the third portion is configured to cover a portion of the backing layer of the first portion in the second state; wherein the second portion and the third portion form a crisscross pattern over a front of the baby's body in the second state; wherein the second portion is configured to completely cover a first arm, both legs, and both feet of the baby, and the third portion is configured completely cover a second arm, both legs, and both feet of the baby in the second state; wherein all three of the first portion, the second portion, and the third portion are configured to receive and at least partially cover at least the baby's legs and feet in the second state; wherein, in the second state, the first portion is configured to completely cover both legs and both feet of the baby, the second portion is configured to completely cover a first arm, both legs, and both feet of the baby, and the third portion is configured completely cover a second arm, both legs, and both feet of the baby; wherein the backing layers of the second and third portions are configured to extend over a front of the baby's body in the second state; and/or wherein the second portion is configured to move from a first position in the first state in which the backing layer of the second portion is in the same plane as the backing layer of the first portion to a second position in the second state in which the backing layer crosses across the baby's body and the front layer of the second portion is in contact with the backing layer of the first portion Seam:

Any of the embodiments of the swaddle wraps or methods of securing a swaddle wrap to a baby disclosed herein can include, in additional embodiments, one or more of the following features, components, steps, and/or details in any combination with any of the other features, components, and/or details of any other embodiments disclosed herein: wherein the first portion is connected to the second portion along a first seam and the first portion is connected to the third portion along a second seam; wherein the first seam directly connects the backing layer of the first portion with the backing layer of the second portion and the second seam directly connects the backing layer of the first portion with the backing layer of the third portion; and/or wherein a first connecting portion between the backing layer of the first portion and the backing layer of the second portion is adjacent to a first shoulder and a first upper arm of the baby and a second connecting portion between the backing layer of the first portion and the backing layer of the third portion is adjacent to a second shoulder and second upper arm when the swaddle wrap is in the second state.

Enclosures and Front Cover:

Any of the embodiments of the swaddle wraps or methods of securing a swaddle wrap to a baby disclosed herein can include, in additional embodiments, one or more of the following features, components, steps, and/or details in any combination with any of the other features, components, and/or details of any other embodiments disclosed herein: wherein the first portion only has one opening therein, the opening being for an enclosure; wherein the second and third portions each only has one opening therein; wherein the second enclosure is configured to receive therein a portion of the first portion of the swaddle wrap in the second state and the third enclosure is configured to also receive therein a portion of the first portion of the swaddle wrap in the second state; and/or wherein the second enclosure is configured to receive therein a portion of the first portion of the swaddle wrap in the second state and the third enclosure is configured to also receive therein a portion of the first portion and the second portion of the swaddle wrap in the second state.

No Zippers, Knots, or Other Fasteners:

Any of the embodiments of the swaddle wraps or methods of securing a swaddle wrap to a baby disclosed herein can include, in additional embodiments, one or more of the following features, components, steps, and/or details in any combination with any of the other features, components, and/or details of any other embodiments disclosed herein: wherein the swaddle wrap is configured to be secured to the baby without a use of zippers, snaps, ties, hook and loop fasteners, buttons, knots, magnets, or other connectors or fasteners other than the second and third enclosures; wherein the swaddle wrap comprises only the first portion, the second portion, and the third portion; wherein the swaddle wrap is configured to be secured to the baby's body using only the second enclosure and the third enclosure; and/or wherein the first portion has a backing layer, a front layer, and a first enclosure between the backing layer and the front layer of the first portion, and the swaddle wrap is configured to be secured to the baby's body using only the first enclosure, the second enclosure, and the third enclosure.

Shape:

Any of the embodiments of the swaddle wraps or methods of securing a swaddle wrap to a baby disclosed herein can include, in additional embodiments, one or more of the following features, components, steps, and/or details in any combination with any of the other features, components, and/or details of any other embodiments disclosed herein: wherein the second portion is sized and configured such that, when a baby is positioned in the swaddle wrap in the second state, the second portion covers a first one of the baby's shoulders but not a second one of the baby's shoulders, and the third portion covers the second one of the baby's shoulders but not the first one of the baby's shoulders; wherein the second portion is sized, positioned, and connected to the first portion such that, when a baby is positioned in the swaddle wrap in the second state, the second portion covers a first one of the baby's shoulders but not a second one of the baby's shoulders, and the third portion covers the second one of the baby's shoulders but not the first one of the baby's shoulders; wherein the first portion, the second portion, and the third portion each has a curved bottom edge; wherein at least one of the first portion, the second portion, and the third portion comprises an enclosure; wherein each of the first portion, the second portion, and the third portion comprises an enclosure sized and configured to cover at least both feet of a baby; wherein, when the swaddle wrap is in the first state before being used to cover the baby, no portion of the second portion or the third portion covers any portion of the first portion; wherein, when the swaddle wrap is in the first state before being used to cover the baby, the second portion is positioned to a first side of the first portion and the third portion is positioned to a second side of the first portion, the second side of the first portion being opposite to the first side of the first portion; wherein no portion of the front layer of the second portion or the third portion is directly attached to any part of the first portion; wherein, when the swaddle wrap is positioned on a flat surface in a relaxed state before being used to cover the baby and the first portion is positioned at an approximately 6 o'clock position with the front layer facing away from the flat surface, the second portion will be positioned at an approximately 8 o'clock position and the third portion will be positioned at an approximately 4 o'clock position; and/or wherein, when the swaddle wrap is positioned on a flat surface in a relaxed state before being used to cover the baby and the first portion is positioned at an approximately 6 o'clock position with the front layer facing away from the flat surface, the second portion will be positioned between and including an approximately 7 o'clock position and an approximately 10 o'clock position and the third portion will be positioned between and including an approximately 2 o'clock position and an approximately 5 o'clock position.

Number of Steps:

Any of the embodiments of the swaddle wraps or methods of securing a swaddle wrap to a baby disclosed herein can include, in additional embodiments, one or more of the following features, components, steps, and/or details in any combination with any of the other features, components, and/or details of any other embodiments disclosed herein: wherein the swaddle wrap is configured to change from the first state in which no portion of the baby's body is covered by the swaddle wrap to the second state in which the baby's body from at least the arms down is completely covered by the swaddle wrap and the swaddle wrap is securable to the baby's body in only three steps; wherein at least one of the three steps comprises positioning the second portion over at least a portion of the baby so that at least both of the baby's feet and a first one of the baby's shoulders are in the second enclosure; wherein at least one of the three steps comprises positioning the third portion over at least a portion of the baby so that at least both of the baby's feet and a second one of the baby's shoulders are in the third enclosure; wherein at least one of the three steps comprises positioning the baby's body on the first portion of the swaddle wrap; wherein the swaddle wrap is configured to change from the first state in which no portion of the baby's body is covered by the swaddle wrap to the second state in which the baby's body from at least the shoulders down is completely covered by the swaddle wrap and the swaddle wrap is secured to the baby's body in only three steps; and/or wherein the swaddle wrap is configured so that a user can completely cover the baby from at least the shoulders down and selectively secure the swaddle wrap to the baby in only three steps.

Fabric:

Any of the embodiments of the swaddle wraps or methods of securing a swaddle wrap to a baby disclosed herein can include, in additional embodiments, one or more of the following features, components, steps, and/or details in any combination with any of the other features, components, and/or details of any other embodiments disclosed herein: wherein the swaddle wrap is made from a fabric material; wherein the swaddle wrap is made from a stretchable fabric material; wherein at least a portion of the swaddle wrap comprises cotton and/or polyester, including without limitation a brushed polyester material; and/or wherein at least a portion of the swaddle wrap comprises spandex or another stretchable material, including without limitation a brushed polyester and spandex blend material; wherein at least a portion of the swaddle wrap (for example and without limitation, the portion(s) of the swaddle wrap configured to surround a baby's feet and/or legs) is made from a mesh material or a lightweight, more porous material.

Method of Use:

Some embodiments of the methods of securing a swaddle wrap to a baby disclosed herein can include at least partially covering the baby with a first portion of the swaddle wrap, the first portion of the swaddle wrap having a first enclosure and the swaddle wrap having a second portion that is coupled with the first portion of the swaddle wrap, and the second portion having a second enclosure, positioning at least both feet of the baby within the first enclosure of the first portion of the swaddle wrap, at least partially covering the baby with the second portion of the swaddle wrap, and covering at least one of the baby's shoulders with the second portion of the swaddle wrap and extending the second enclosure over at least the baby's feet and a portion of the first enclosure of the first portion of the swaddle wrap so that at least both feet of the baby and a portion of the first enclosure of the first portion of the swaddle wrap are positioned within the second enclosure of the swaddle wrap. In any embodiments disclosed herein, the first portion of the swaddle wrap can be configured to not have a pouch or enclosure, and/or be configured to not enclose the baby's feet or legs.

Any of the embodiments of the swaddle wraps or methods of securing a swaddle wrap to a baby disclosed herein can include, in additional embodiments, one or more of the following features, components, steps, and/or details in any combination with any of the other features, components, and/or details of any other embodiments disclosed herein: further comprising positioning the baby in the first portion of the swaddle wrap so that a first shoulder of the baby is positioned within the first enclosure of the first portion of the swaddle wrap, wherein securing the second portion of the swaddle wrap to the baby comprises securing the second portion of the swaddle wrap to the baby by covering a second shoulder of the baby with the second portion of the swaddle wrap; wherein securing the swaddle wrap to the baby requires only the following steps: covering at least a portion of a first shoulder of the baby with the first portion of the swaddle wrap, positioning at least both feet of the baby within the first enclosure of the first portion of the swaddle wrap, covering at least a portion of a second shoulder of the baby with the second portion of the swaddle wrap, and extending the second enclosure over at least the baby's feet and a portion of the first enclosure of the first portion of the swaddle wrap so that at least both feet of the baby and a portion of the first enclosure of the first portion of the swaddle wrap are positioned within the second enclosure of the swaddle wrap; and/or wherein the first portion of the swaddle wrap does not cover any portion of the second shoulder of the baby.

Bodysuit Garment:

There is a need for an easy to dress garment without fasteners or the need to pull over the garment over the person's head. The systems, methods and apparatuses of this disclosure each have several innovative aspects, implementations, or aspects, no single one of which is solely responsible for the desirable attributes disclosed herein.

Some embodiments of the garments for covering at least an upper body of a person disclosed herein can include a body portion having an upper portion and a lower portion, a first flap portion coupled with the body portion, the first flap portion having a first loop, and a second flap portion coupled with the body portion, the second flap portion having a second loop. In any garment apparatus embodiments disclosed herein, the first flap portion can be configured to extend over a front of the person's body so as to substantially cover the front of the person's body, the second flap portion can be configured to extend over the front of the person's body so as to also substantially cover the front of the person's body, the first loop can be configured to secure the first flap portion to at least one of the legs of the person, and the second loop can be configured to secure the second flap portion to at least one of the legs of the person. Note that any of the embodiments disclosed herein can be sized and configured for dressing an infant, a baby, a child, a toddler or even older persons. Such persons are collectively referred to herein as a person, which term is meant to signify any or all of the foregoing persons.

Any of the embodiments of the garments or methods of securing a garment to a person disclosed herein can include, in additional embodiments, one or more of the following features, components, steps, and/or details in any combination with any of the other features, components, and/or details of any other embodiments disclosed herein: further comprising a first armhole and a second armhole in the body portion configured to receive the arms of the person; further comprising a first leghole and a second leghole in the body portion configured to receive the legs of the person; wherein the apparatus is configured to cover at least the upper body of the person without passing over the head of the person when being dressed with the garment; and/or wherein the body portion is configured to cover at least the person's back and a top portion of the person's shoulders.

Additional embodiments of the garments for covering at least an upper body of a person are disclosed herein and can include a body portion having an upper portion and a lower portion, a first arm portion coupled with the upper portion of the body portion and having a first armhole therein, a second arm portion coupled with the upper portion of the body portion and having a second armhole therein, a first leg portion coupled with the lower portion of the body portion and having a first leghole therein, a second leg portion coupled with the lower portion of the body portion and having a second leghole therein, a first flap portion coupled with the body portion, the first flap portion having a first loop element, and a second flap portion coupled with the body portion, the second flap portion having a second loop element. In any embodiments disclosed herein, the first leghole can be configured to receive a first leg of the person and the second leghole can be configured to receive a second leg of the person in a second state, wherein the second state is where the garment is fully secured to the person. Further, the first flap portion can be configured to extend across a front of the person's body so that the first loop element can be advanced over the second leg of the person to secure at least the first flap portion to the user's body, and the second flap portion can be configured to extend across a front of the person's body so that the second loop element can be advanced over the first leg of the person to secure at least the second flap portion to the user's body.

Any of the garments disclosed herein can be configured to cover at least the upper body of the person without passing over the head of the person when being dressed with the garment. Further, any of the body portions of the garments disclosed herein can be configured to cover at least the person's back and a top portion of the person's shoulders. Any of the embodiments of the garments or methods of securing a garment to a person disclosed herein can include, in additional embodiments, one or more of the following features, components, steps, and/or details in any combination with any of the other features, components disclosed herein: wherein the garment is configured to cover at least the upper body of a person without requiring any portion of the garment to be passed over a head of the person; wherein the garment is configured to be secured to the person's body without forming a continuous, uninterrupted or non-openable enclosure around a neck of the person; wherein the garment does not have a continuous, uninterrupted or non-openable enclosure for going over a head of the person or around a neck of the person; wherein the garment is configured to be secured to the body of the person without passing over a head of the person and without the use of any fasteners; wherein the first flap portion is configured to extend from a first side of the person's body across the front of the person's body toward a second side of the person's body, and the first loop element is advanced over the second leg of the person that is on the second side of the person's body in the second state; wherein the second flap portion is configured to extend from a second side of the person's body across the front of the person's body toward a first side of the person's body, and the second loop element is advanced over the first leg of the person that is on the first side of the person's body in the second state; and/or wherein the second flap portion is a mirror image of the first flap portion.

Any of the embodiments of the garments or methods of securing a garment to a person disclosed herein can include, in additional embodiments, one or more of the following features, components, steps, and/or details in any combination with any of the other features, components disclosed herein: wherein the second flap portion is configured to cover a substantial portion of the first flap portion in the second state; wherein the second flap portion is configured to cover a majority of the first flap portion in the second state; wherein the second flap portion is configured to cover at least 75% of the first flap portion in the second state; wherein either the first flap portion or the second flap portion is configured to directly contact and overlap at least a portion of the body portion in the second state (such as, for example and without limitation, when the second flap portion is passed over a front of the person's body before the first flap portion is passed over the front of the person's body); wherein of the first flap portion is configured to directly contact and overlap at least the lower portion of the body portion in the second state; wherein the second flap portion is configured to directly contact and overlap at least a portion of the body portion in the second state; wherein the second flap portion is configured to directly contact and overlap at least the lower portion of the body portion in the second state; wherein the first flap portion and the second flap portion form a crisscross pattern over a front of the person's body in the second state; wherein the first and second flap portions are configured to completely cover a stomach and cover a majority of chest of the person's body in the second state; wherein the first flap portion is configured to move from a first position in a first state in which the first flap portion is in the same plane as the body portion to the second position in the second state in which the first flap portion is secured across a chest and stomach of the person's body; wherein the second flap portion is configured to move from a first position in a first state in which the second flap portion is in the same plane as the body portion to the second position in the second state in which the second flap portion is secured across a chest and stomach of the person's body; wherein the body portion is connected to the first flap portion along a first seam and the body portion is connected to the second flap portion along a second seam; wherein the body portion and at least one of the first flap portion and the second flap portion can be made from a continuous, uninterrupted piece of material such that there are no seams between the body portion and at least one of the first flap portion and the second flap portion along a front side or front layer and/or along a back side or back layer of the garment and/or wherein the garment is configured to be secured to the person without a use of zippers, snaps, ties, hook and loop fasteners, buttons, knots, or other connectors or fasteners other than the first and second loop elements; wherein the garment comprises only the body portion, the first flap portion, and the second flap portion.

Any of the embodiments of the garments or methods of securing a garment to a person disclosed herein can include, in additional embodiments, one or more of the following features, components, steps, and/or details in any combination with any of the other features, components disclosed herein: wherein the garment is configured to be secured to the person's body using only the first and second armholes, the first and second legholes, and the first and second loop elements; wherein the garment is configured to be secured to the person's body using only the body portion, the first flap portion, and the second flap portion; wherein, when the garment is in the first state before being used to cover the person, no portion of the first flap portion or the second flap portion covers any portion of the body portion; wherein, when the garment is in the first state before being used to cover the person, the first flap portion is positioned to a first side of the body portion and the second flap portion is positioned to a second side of the body portion, the second side of the body portion being opposite to the first side of the body portion; wherein the garment is made from a fabric material; wherein the garment is made from a stretchable fabric material; wherein the garment comprises an insulated material; and/or wherein the garment comprises a padded material.

Some embodiments of methods of securing a garment to a person disclosed herein can include at least partially covering a back of the person with a body portion of the garment, at least partially covering a front of the person with a first flap portion that can be coupled with the body portion by extending the first flap portion over a front of the person, securing a distal end portion of the first flap portion to at least one of the person's legs to secure the first flap portion to the person, extending a second flap portion that can be coupled with the body portion over the front of the person to completely cover the front of the person, and securing a distal end portion of the second flap portion to at least one of the person's legs to secure the second flap portion to the person.

Any of the embodiments of the garments or methods of securing a garment to a person disclosed herein can include, in additional embodiments, one or more of the following features, components, steps, and/or details in any combination with any of the other features, components disclosed herein: further comprising securing at least a lower portion of the body portion to the body of the person by securing the lower portion of the body portion to the person's legs; further comprising securing at least a lower portion of the body portion to the body of the person by advancing at least one of the person's legs through at least a first leghole of the body portion; further comprising securing at least an upper portion of the body portion to the body of the person by securing the upper portion of the body portion to the person's arms; further comprising securing at least an upper portion of the body portion to the body of the person by advancing at least one of the person's arms through at least a first armhole of the body portion; wherein the garment is configured to be applied to the person's body without forming a continuous, uninterrupted or non-openable enclosure around a neck of the person; and/or wherein the garment is configured to be applied to the person's body without going over a head of the person.

There is a need for a top that is easy to clothe a baby with, or an easy to dress garment. Dressing your baby does not need to be an uncomfortable process for the baby or caretaker, nor should it be difficult or time-consuming. The systems, methods and devices of this disclosure each have several innovative aspects, implementations, or aspects, no single one of which is solely responsible for the desirable attributes disclosed herein. Some embodiments of the garments for covering at least an upper body of a person disclosed herein can include a body portion having a first side and a second side, the second side being opposite to the first side, a first armhole configured to receive a first arm of the person, a second armhole configured to receive a second arm of the person, a first flap portion coupled with the body portion and extending away from the first side of the body portion, a second flap portion coupled with the body portion and extending away from the second side of the body portion, a first arm portion coupled with the first flap portion and having a third armhole therein, and/or a second arm portion coupled with the second flap portion and having a fourth armhole therein.

Any of the embodiments of the garments or methods of securing a garment to a person disclosed herein can include, in additional embodiments, one or more of the following features, components, steps, and/or details in any combination with any of the other features, components, and/or details of any other embodiments disclosed herein: wherein the first armhole can be configured to receive a first arm of the person therethrough and the second armhole can be configured to receive a second arm of the person therethrough; the first flap portion can be configured to extend across a front of at least the upper body of the person so that the first arm portion can be passed over the second arm of the person before the second arm of the person has been passed through the second armhole to secure at least an upper portion of the first flap portion to the user's body; wherein the second flap portion can be configured to extend across a front of at least the upper body of the person so that the second arm portion can be passed over the first arm of the person after the first arm of the person has been passed through the first armhole to secure at least an upper portion of the second flap portion to the user's body; wherein the garment can be configured such that the second arm of the person and the first arm portion of the first flap portion can be passed through the second armhole after the first flap portion has been extended across the front of at least the upper body of the person; wherein the body portion of the garment can be configured to cover a back of at least the upper body of the person when the person is clothed with the garment in the second state; wherein the garment can be configured to cover at least the upper body of a person without requiring any portion of the garment to be passed over a head of the person; wherein the garment can be configured to be secured to the person's body without forming a continuous, uninterrupted or non-openable enclosure around a neck of the person; wherein the garment does not have a continuous, uninterrupted or non-openable enclosure for going over a head of the person or around a neck of the person; and/or wherein the garment can be configured to be secured to the body of the person without passing over a head of the person and without the use of any fasteners.

Further, any of the embodiments of the garments or methods of securing a garment to a person disclosed herein can include, in additional embodiments, one or more of the following features, components, steps, and/or details in any combination with any of the other features, components, and/or details of any other embodiments disclosed herein: wherein the second flap portion is a mirror image of the first flap portion; wherein a size and a shape of the second flap portion is approximately the same as a size and a shape of the first flap portion; wherein a size and a shape of the second flap portion is slightly larger than a size and a shape of the first flap portion; wherein the second flap portion can be configured to cover a substantial portion of the first flap portion in the second state; wherein the second flap portion can be configured to cover a majority of the first flap portion in the second state; wherein the second flap portion can be configured to cover at least 75% of the first flap portion in the second state; wherein the second flap portion can be configured to cover at least 85% of the first flap portion in the second state; wherein the first and second flap portions are configured to completely cover a stomach and chest of the person's body in the second state; wherein the first flap portion can be configured to move from a first position in a first state in which the first flap portion is in the same plane as the body portion to a second position in which the first flap portion is secured across a chest and stomach of the person's body; wherein the second flap portion can be configured to move from a first position in a first state in which the second flap portion is in the same plane as the body portion to a second position in which the second flap portion is secured across a chest and stomach of the person's body; wherein the garment can be configured to be secured to the person without a use of zippers, snaps, ties, hook and loop fasteners, buttons, knots, or other connectors or fasteners; wherein the garment can be configured to be secured to the person without a use of any other fasteners; wherein the garment comprises only the body portion having the first and second armholes, the first flap portion having the first arm portion, and the second flap portion having the second arm portion; wherein the garment can be configured to be secured to the person's body using only the first, the second, the third, and the fourth armholes; wherein the garment can be configured to be secured to the person's body using only the body portion, the first flap portion, and the second flap portion; and/or wherein, when the garment is in the first state before being used to cover the person, the first flap portion can be positioned to a first side of the body portion and the second flap portion can be positioned to a second side of the body portion, the second side of the body portion being opposite to the first side of the body portion.

Further, any of the embodiments of the garments or methods of securing a garment to a person disclosed herein can include, in additional embodiments, one or more of the following features, components, steps, and/or details in any combination with any of the other features, components, and/or details of any other embodiments disclosed herein: wherein the garment is made from a fabric material; wherein the garment is made from a stretchable fabric material; wherein the garment comprises an insulated material; wherein the garment comprises a padded material; and/or wherein the garment can be sized and configured for clothing any desired sized person, including babies, toddlers, adolescents, adults, and older adults.

Some embodiments of methods of securing a garment to a person disclosed herein can include at least partially covering a back of the person with a body portion of the garment, at least partially covering a front of at least an upper body of the person with a first flap portion that is coupled with the body portion by extending the first flap portion over a front of the person, securing a distal end portion of the first flap portion to at least one of the person's arms to secure the first flap portion to the person, extending a second flap portion that is coupled with the body portion over the front of the upper body of the person to cover the front of the upper body of the person, and/or securing a distal end portion of the second flap portion to at least one of the person's arms to secure the second flap portion to the person.

Any of the embodiments of the garments or methods of securing a garment to a person disclosed herein can include, in additional embodiments, one or more of the following features, components, steps, and/or details in any combination with any of the other features, components disclosed herein: further comprising securing at least a lower portion of the body portion to the body of the person by securing the lower portion of the body portion to at least one leg of the person; further comprising securing at least a lower portion of the body portion to the body of the person by advancing at least one of the person's legs through at least a first leghole of the body portion; further comprising securing at least an upper portion of the body portion to the body of the person by passing at least one of the person's arms through at least a third armhole of the garment; wherein the garment can be configured to be applied to the person's body without the garment having a continuous, uninterrupted or non-openable enclosure around a neck of the person; and/or wherein the garment can be configured to be applied to the person's body without going over a head of the person.

DETAILED DESCRIPTION OF THE SOME EXEMPLIFYING EMBODIMENTS

Figure 1A:
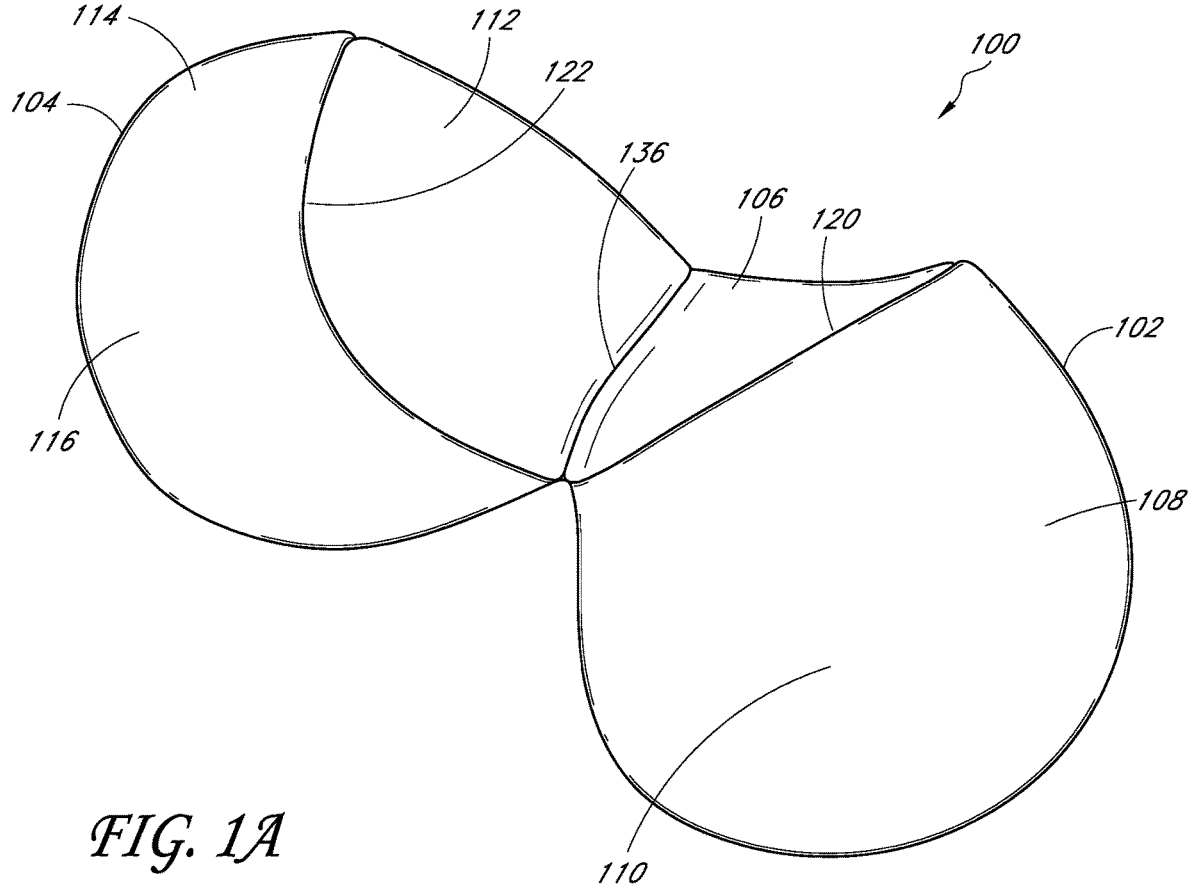
FIG. 1A shows a front view of an embodiment of a swaddle wrap in a first state on a planar surface.
Figure 1B:
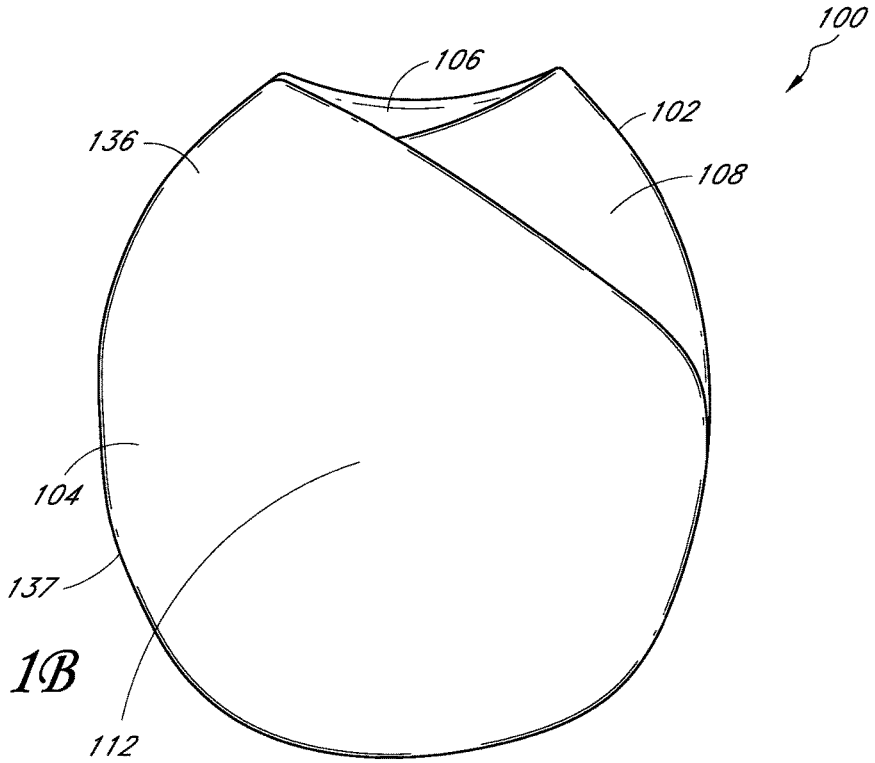
FIG. 1B shows a front view of the embodiment of the swaddle wrap in a second state on a planar surface, but without a baby therein.

The swaddle wraps and methods of securing a swaddle wrap or method of swaddling a baby of this disclosure each have many innovative aspects, implementations, or aspects, no single one of which is solely responsible for the desirable attributes disclosed herein. FIGS. 1A and 1B show a front view of an embodiment of a swaddle wrap 100. As shown in FIG. 1A, any embodiments of the swaddle wraps disclosed herein can have a first portion 102 and a second portion 104. The first portion 102 can have a backing layer 106, a front layer 108, and a first enclosure 110 between the backing layer 106 and the front layer 108.

Figure 3:
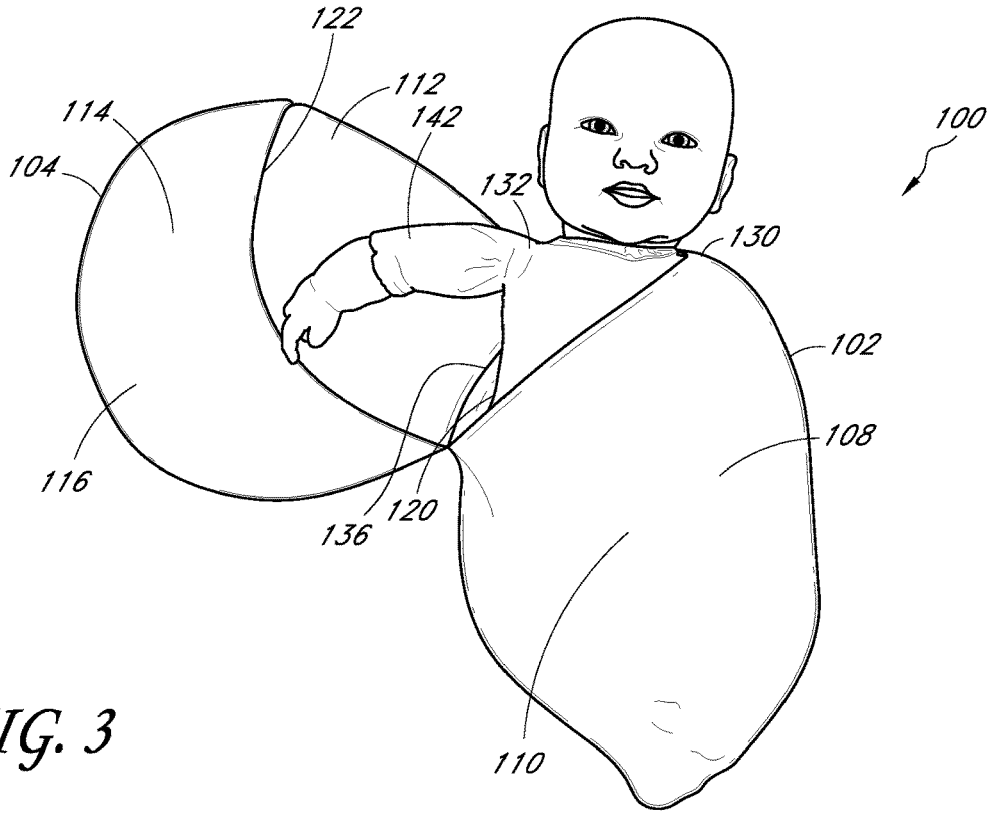
FIG. 3 shows a front view of the embodiment of the swaddle wrap shown in FIG. 1A, with a majority of the baby's body positioned in the first enclosure of the first portion of the swaddle wrap, and with the second portion still in the first position.
Figure 4:
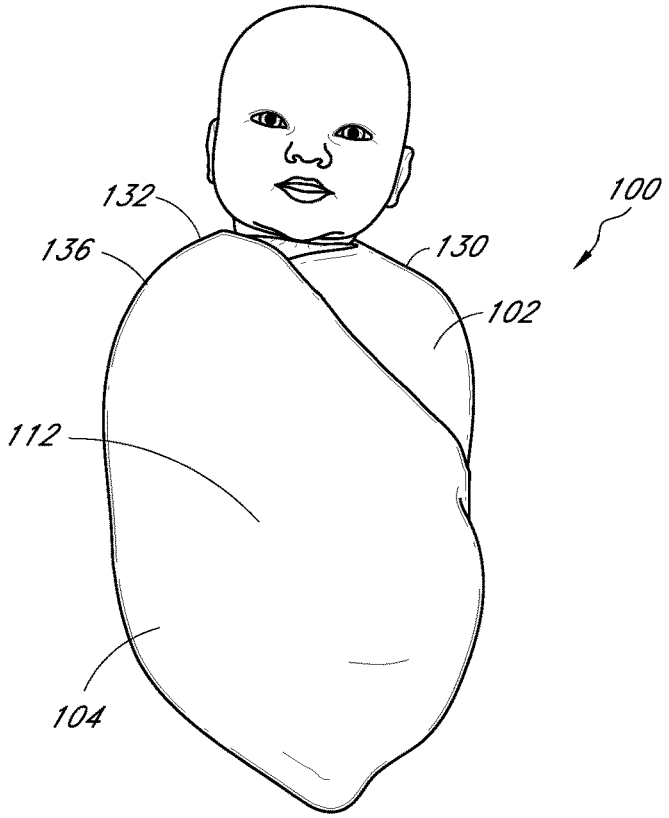
FIG. 4 shows a front view of the embodiment of the swaddle wrap shown in FIG. 1A, with a baby positioned in the first enclosure of the first portion of the swaddle wrap, and showing the swaddle wrap after the second portion has been extended over the front of the baby and such that the second enclosure has been positioned over at least the baby's feet and a portion of the first portion so that at least the baby's feet and a portion of the first portion of the swaddle wrap are positioned within the second enclosure.
Figure 5:
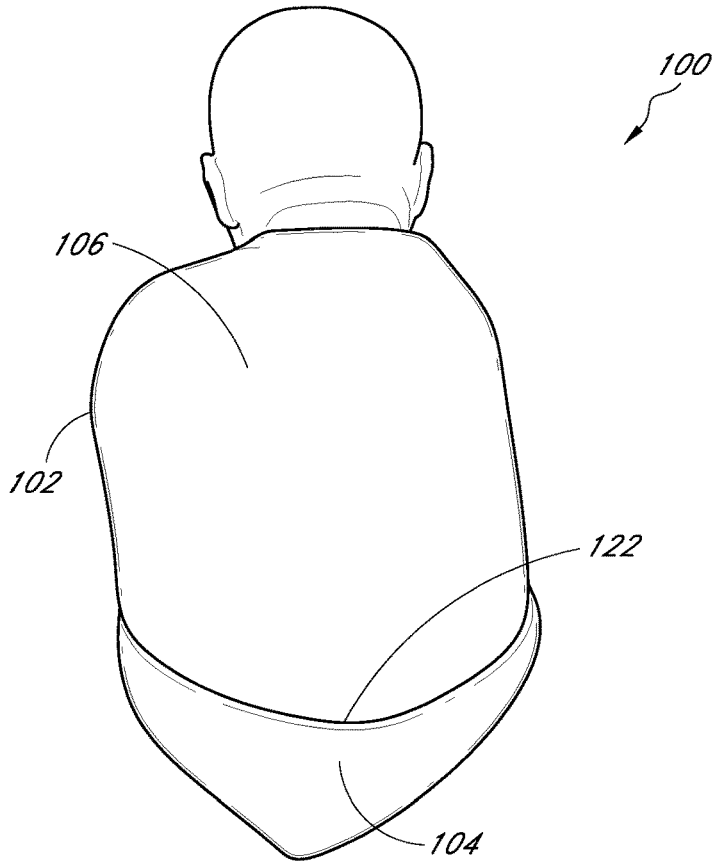
FIG. 5 shows a back view of the embodiment of the swaddle wrap shown in FIG. 1A, showing the swaddle wrap in the second or closed state.
Figure 6:
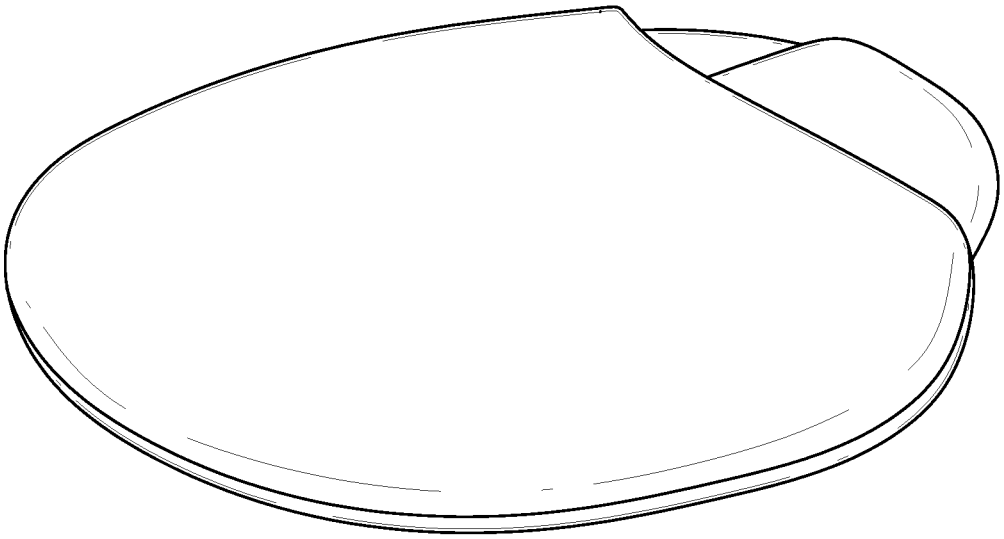
FIG. 6 shows an orthogonal view of the embodiment of the swaddle wrap shown in FIG. 1A, showing the swaddle wrap in the first state and as if the swaddle wrap were resting on a planar surface.
Figure 7:
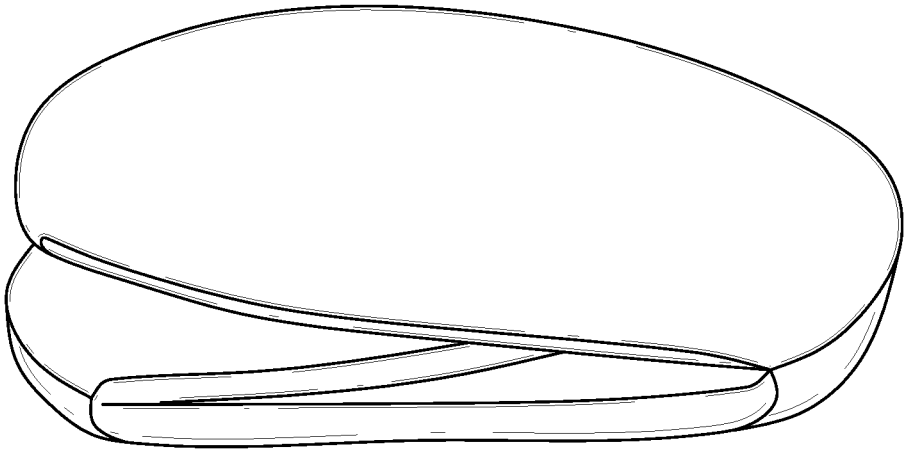
FIG. 7 shows a top view of the embodiment of the swaddle wrap shown in FIG. 1A, showing the swaddle wrap in the first state and as if the swaddle wrap were resting on a planar surface.
Figure 8:
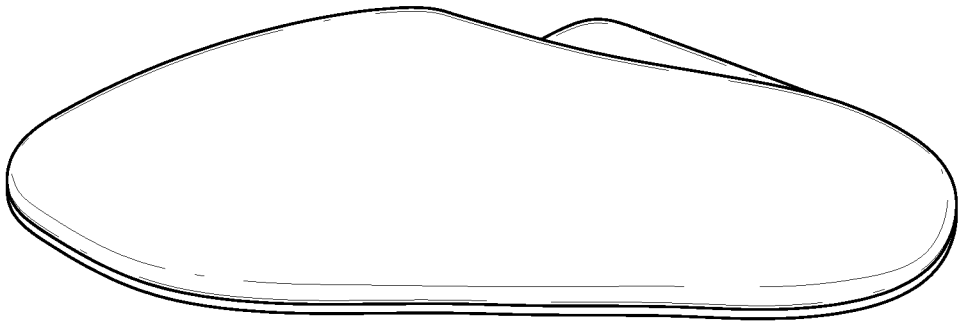
FIG. 8 shows a bottom view of the embodiment of the swaddle wrap shown in FIG. 1A, showing the swaddle wrap in the first state and as if the swaddle wrap were resting on a planar surface.
Figure 9:
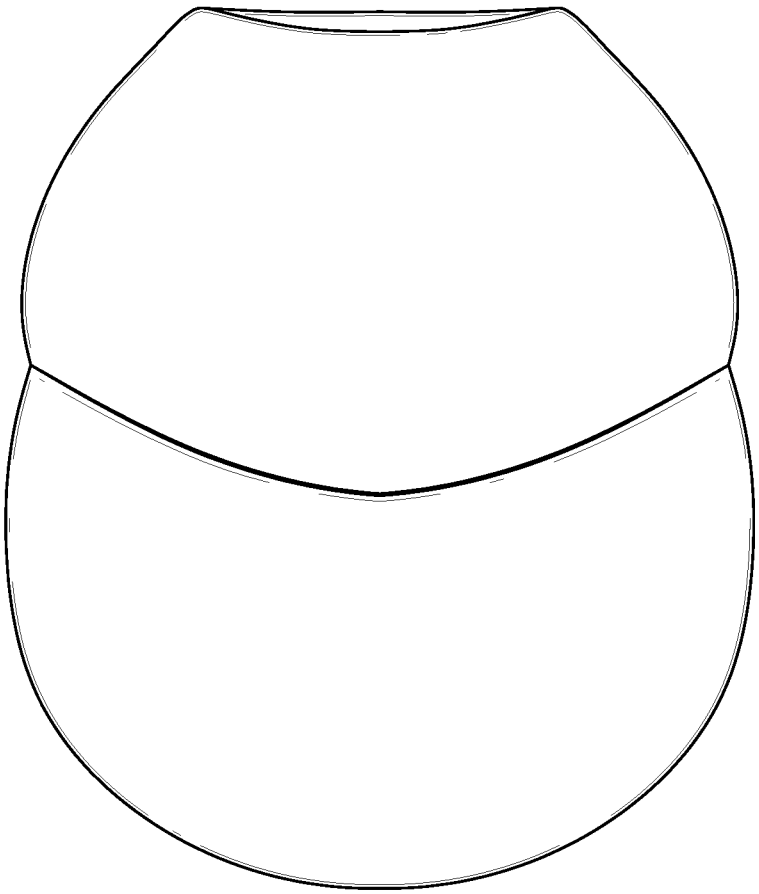
FIG. 9 is a back view of the embodiment of the swaddle wrap shown in FIG. 1A, showing the swaddle wrap in the first state and as if the swaddle wrap were resting on a planar surface.
Figure 10:
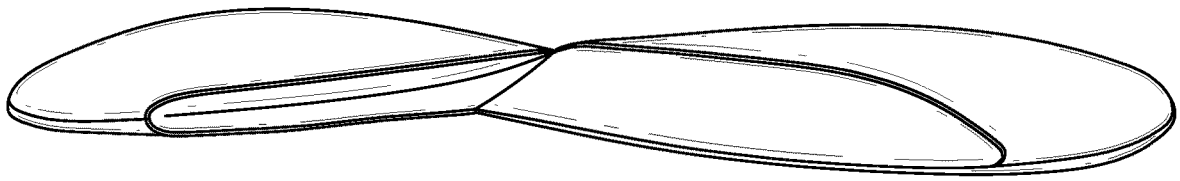
FIG. 10 is a top view of the embodiment of the swaddle wrap shown in FIG. 1A, showing the swaddle wrap in the first or open state and as if the swaddle wrap were resting on a planar surface.
Figure 11:
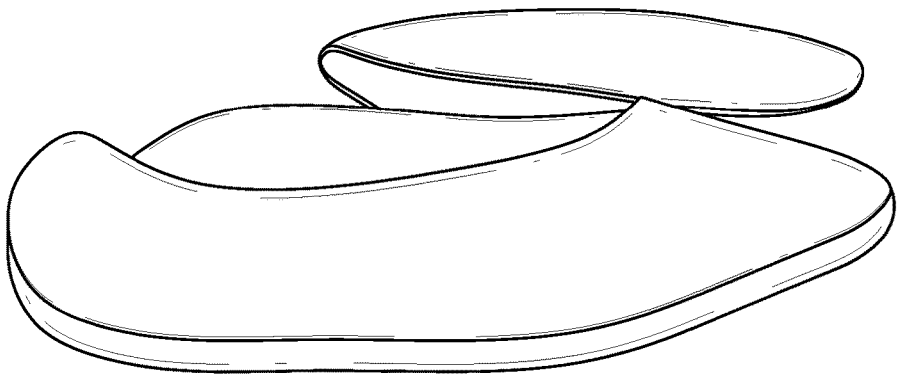
FIG. 11 is a left side view of the embodiment of the swaddle wrap shown in FIG. 1A, showing the swaddle wrap in the first state and as if the swaddle wrap were resting on a planar surface.
Figure 12:
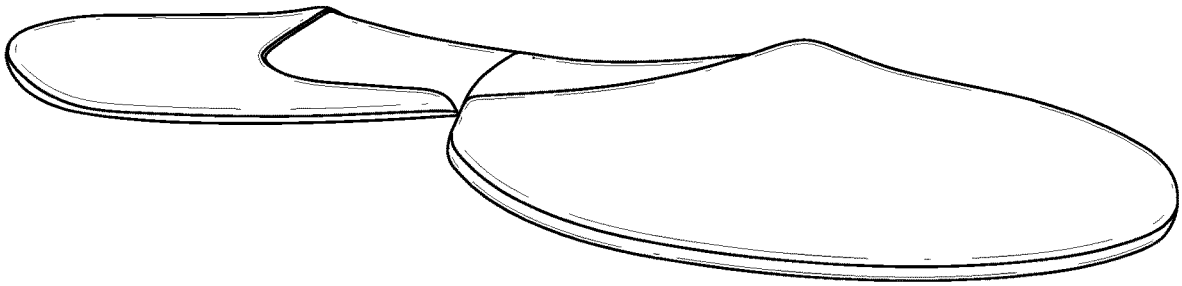
FIG. 12 is a bottom view of the embodiment of the swaddle wrap shown in FIG. 1A, showing the swaddle wrap in the first state and as if the swaddle wrap were resting on a planar surface.
Figure 13:
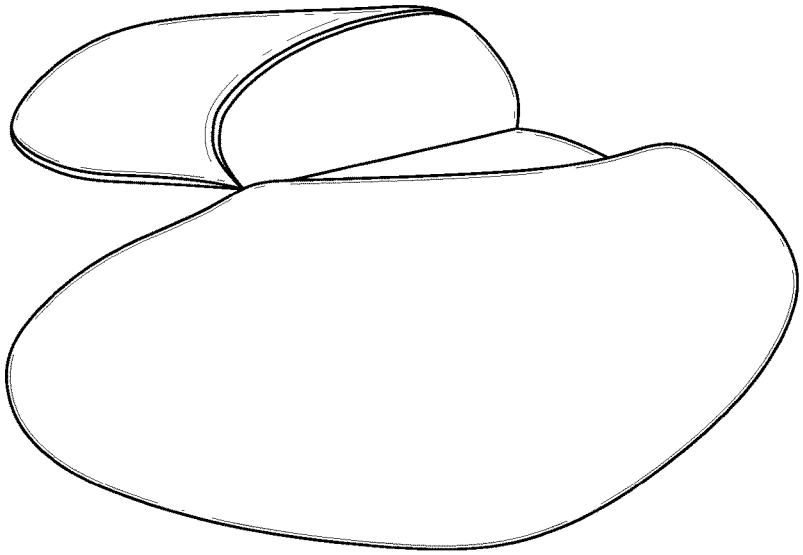
FIG. 13 is a right side view of the embodiment of the swaddle wrap shown in FIG. 1A, showing the swaddle wrap in the first state and as if the swaddle wrap were resting on a planar surface.

In any embodiments of the swaddle wraps and/or methods of swaddling disclosed herein, the second portion 104 can have a backing layer 112, a front layer 114, and a second enclosure 116 between the backing layer 112 and the front layer 114 of the second portion 104. In some embodiments, the swaddle wrap can be configured to be moved from a first state (i.e., a first, relaxed state, in which the swaddle wrap has not yet been applied to the baby, as shown in FIG. 1A) to a second state (in which the baby has been fully wrapped or swaddled by the swaddle wrap, i.e., the swaddle wrap has been fully secured to the baby, as shown in FIGS. 4 and 5). In any embodiments, the first enclosure 110 can be configured to receive and/or cover one or both arms therein, either completely or partially. For example and without limitation, the first enclosure can be configured to at least partially cover a first upper arm portion 140 of the baby, or the entire first arm of the baby. Further, in any embodiments, the first enclosure can also be configured to at least partially cover the baby's second arm, for example and without limitation, at least a portion of the baby's second arm below the second upper arm portion 142 of the baby. Further, in some embodiments, the first enclosure 110 can be configured to receive therein at least both feet of a baby (as shown in FIG. 3), and/or the second enclosure 116 can be configured to receive therein at least both feet of the baby in the second state (as shown in FIGS. 4 and 5) to secure the swaddle wrap to the baby without the use of any fasteners or ties. In any embodiments disclosed herein, the second portion 104 can be configured to extend around at least the baby's feet in the second state to secure the swaddle wrap 100 to the baby's body. As shown in FIGS. 4 and 5, the baby is positioned in the first enclosure 110 of the first portion 102 of the swaddle wrap 100 and second portion 104 has been extended over the front of the baby such that the second enclosure 116 of the second portion 104 has been positioned over at least the baby's feet and a portion of the first portion 102 of the swaddle wrap 100 so that at least the baby's feet and a portion of the first portion 102 of the swaddle wrap 100 are positioned within the second enclosure 116 of the second portion 104.

Some embodiments of the swaddle wrap can be made from a stretchable material or otherwise be extendable around or over portions of the body of the baby, such as, but not limited to, the feet and/or shoulders, to secure the swaddle wrap to the baby. Additionally, in any embodiments disclosed herein, the second portion 104 can be configured to be extended around at least one of the baby's shoulders and both feet of the baby to secure the swaddle wrap 100 to the baby's body. Further, in any embodiments disclosed herein, the swaddle wrap can be configured to have more space within the swaddle wrap to accommodate one or both of the baby's shoulders. This can make the swaddle wrap more comfortable and provide a more snug and more anatomical fit over the baby's shoulders. In some embodiments, this can be achieved by providing more material in the front and/or backing layers of the first portion, the second portion, and/or the third portion that the baby's shoulders can be received in or that can surround the baby's shoulders without stretching the material around the shoulders more than other portions of the swaddle wrap.

No Zippers, Knots, or Other Fasteners:

Any embodiments disclosed herein, including the embodiments of the swaddle wrap 100 disclosed herein, can be configured to be secured to the baby without using any zippers, snaps, ties, hook and loop fasteners, buttons, knots, magnets, or other connectors or fasteners (collectively referred to hereinafter as fasteners) other than the first and second enclosures 110, 116. This can make the embodiments of the swaddle wrap quicker, easier, more intuitive and/or less intimidating for a user to secure the swaddle wrap to the baby. With the swaddle wrap embodiments disclosed herein, there is no need to align zipper parts and no need to align strips or patches of hook and loop fasteners to secure the swaddle wrap over/across the baby in the swaddle position, significantly less risk of waking the baby while trying to align such fasteners, no risk of waking the baby with the loud noise often associated with hook and loop fasteners and zipper fasteners, no risk of zipping the baby's precious skin to secure swaddle wrap or waking baby with noisy zipper when changing the baby, no more frustrations with tedious snap and button alignment that make the swaddling process more tedious and complicated than necessary. With the swaddle wrap embodiments disclosed herein, there is also no need to align magnets or knot any excess fabric in order to secure the fabric and no risk of baby not being securely compact within the swaddle wrap (in which the baby can be, but is not required to be, in a womb-like position. For example and without limitation, in some embodiments, the swaddle wrap 100 can be configured to use only the first portion 102 and the second portion 104 and/or the enclosures 110, 116 thereof, to secure the swaddle wrap 100 to the baby, without the use of any fasteners. In some embodiments, the swaddle wrap 100 can be configured to be secured to the baby's body using only the first enclosure 110 and the second enclosure 116.

Further, some embodiments of the swaddle wrap 100 can be configured such that the first enclosure 110 and the second enclosure 116 face in opposite directions in the second state. An example of this is shown in FIG. 4. This can help create a more secure overall wrap or enclosure about the baby. In other words, some embodiments of the swaddle wrap can be configured such that the opening 120 of the first portion 102 faces the opening 122 of the second portion 104 when the swaddle wrap 100 is in the second state.

Shoulder Coverage:

In some embodiments, to help secure the swaddle wrap 100 to the baby, the first portion 102 can be configured to cover a first shoulder 130 and a first upper arm portion 140 of the baby (as shown in FIG. 3) when the baby is in the first enclosure 110 in the second state so that a portion of the first portion 102 is positioned over the top of and around the baby's first shoulder 130 in the second state. In any embodiments disclosed herein, the first portion 102 can be configured so that it does not cover a second shoulder 132 of the baby when the baby is in the first enclosure 110 in the second state. Further, the second portion 104 (for example and without limitation, a backing layer 112 of the second portion 104) can be configured to cover a second shoulder 132 of the baby in the second state so that a portion of the second portion 104 is positioned over the top of the baby's second shoulder 132 and around the baby's second shoulder 132 in the second state. In any embodiments disclosed herein, the baby's arm, including but not limited to the baby's upper arm portion 142, can also be covered by the second portion 104 in the second state. In some embodiments, the swaddle wrap 100 can be configured such that any portion of the swaddle wrap 100 covers and is positioned over the baby's second shoulder in the second state, which can be a portion of the first portion 102 of the swaddle wrap that is stretched over the baby's second shoulder in the second state, or otherwise. Further, any embodiments of the swaddle wrap 100 can be configured such that the first portion 102 covers both shoulders of the baby and/or such that the second portion 104 does not cover either shoulder of the baby. Any embodiments of the swaddle wrap 200 can be configured such that the first portion 202 covers both shoulders of the baby and/or such that neither the second portion 204 nor the third portion 206 covers either shoulder of the baby.

The swaddle wrap 100 can be configured such that no portion of the swaddle wrap 100 goes over the baby's head during the process of covering the baby with the swaddle wrap 100.

Backing Layer:

In some embodiments, the backing layer 112 of the second portion 104 can be configured to cover a substantial portion of the front layer 108 of the first portion 102 in the second state. For example and without limitation, the backing layer 112 of the second portion 104 can be configured to cover a majority of the front layer 108 of the first portion 102 in the second state, for example and without limitation, at least 60% of the front layer 108, or at least 75% of the front layer 108, or from approximately 50% to approximately 90% or more of the first portion 102 in the second state. The swaddle wrap 100 can be configured such that the backing layer 112 of the second portion 104 can directly contact and overlap at least a portion of the first portion 102. The swaddle wrap 100 can be configured such that the front layer 114 of the second portion 104 can cover a portion of the backing layer 106 of the first portion 102 in the second state, such that the first portion 102 and the second portion 104 form a crisscross pattern over a front of the baby's body in the second state, and/or such that the first portion 102 completely covers a first arm, both legs, and both feet of the baby, and the second portion 104 completely covers a second arm, both legs, and both feet of the baby in the second state.

Figure 2:
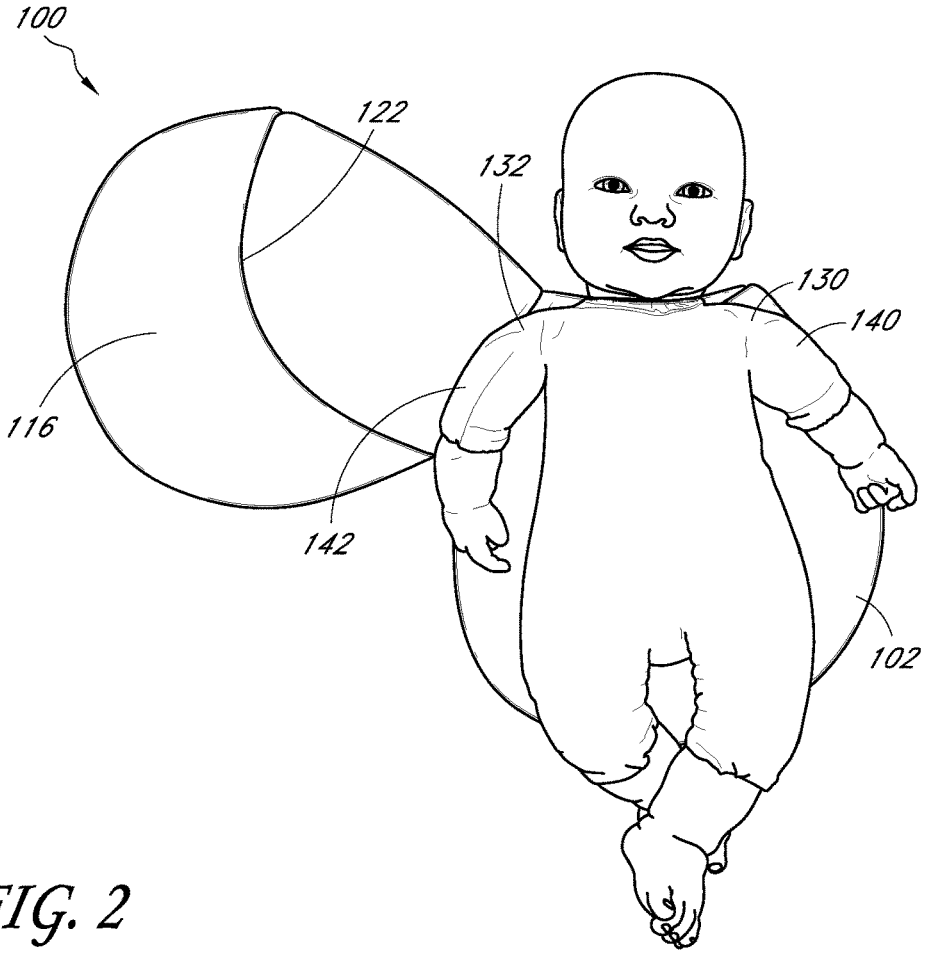
FIG. 2 shows a front view of the embodiment of the swaddle wrap shown in FIG. 1A, with a baby positioned on a portion of the swaddle wrap.

The swaddle wrap 100 can be configured such that both the first portion 102 and the second portion 104 receive and at least partially cover at least the baby's legs and feet in the second state. Further, the swaddle wrap 100 can be configured such that the backing layer 112 of the second portion 104 can be configured to extend over a front of the baby's body in the second state. In any embodiments, the second portion 104 can be configured to move from a first position in the first state in which the backing layer 112 of the second portion 104 is in the same plane as the backing layer 106 of the first portion 102 (as shown in FIGS. 1 and 2) to a second position in the second state in which the backing layer crosses across the baby's body and the front layer 114 of the second portion 104 is in contact with the backing layer 106 of the first portion 102 (as shown in FIGS. 4 and 5).

Seam:

In any embodiments, the first portion 102 can be connected to the second portion 104 along a connecting portion 136 (which can be a seam). The connecting portion 136 can directly connect the backing layer 106 of the first portion 102 with the backing layer 112 of the second portion 104. The connecting portion 136 between the backing layer 106 of the first portion 102 and the backing layer 112 of the second portion 104 can be adjacent to a shoulder (such as second shoulder 132) and an upper arm portion 142 of the baby when the baby is positioned in the first portion 102. Further, in any embodiments disclosed herein, the swaddle wrap 100 can be configured and made such that the first portion and the second portion are made from a single and/or continuous piece of fabric, and/or so that there is no seam between the first and second portions on either or both of the front layer and the back layer of the first and second portions. In some embodiments, the second portion 104 can have a seam 137 between the front layer 114 of the second portion 104 and the backing layer 112 of the second portion 104.

Shape:

Any embodiments can be configured such that the first portion 102 only has one opening therein, such as the opening 120 of the first enclosure 110, and/or the second portion 104 only has one opening therein, such as the opening 122 of the second enclosure 116. Any of the embodiments of the swaddle wraps or methods of securing a swaddle wrap 100 to a baby disclosed herein can be configured such that, when a baby is positioned in the swaddle wrap 100 in the second state, the second portion 104 can cover a first shoulder 130 of the baby but not a second shoulder 132 of the baby. The second portion 104 can be sized, positioned, and connected to the first portion 102 such that, when a baby is positioned in the swaddle wrap 100 in the second state, the second portion 104 covers a first one of the baby's shoulders but not a second one of the baby's shoulders. For example and without limitation, in any embodiments disclosed herein, the second portion 104 can be on either side of the first portion 102. Additionally, the first portion 102 can be configured to cover the baby's first shoulder 130 but not the baby's second shoulder 132, and the second portion 104 can be configured to cover the baby's second shoulder 132 but not the baby's first shoulder 130.

In some embodiments, the first portion 102 and the second portion 104 can both have a curved bottom edge, and/or at least one of the first portion 102 and the second portion 104 can have an enclosure. Further, in any embodiments, an opening 120 of the enclosure 110 in the first portion 102 and/or the front layer 108 of the swaddle wrap 100 can be at an angle such that, when a baby is positioned in the swaddle wrap 100 in the second state, the front layer 108 of the first portion 102 covers only one of the baby's shoulders (for example and without limitation, the baby's first shoulder 130, which can be either the left or the right shoulder). The front layer 108 of the first portion 102 of the swaddle wrap 100 can be shaped and configured such that, when a baby is positioned in the swaddle wrap 100 in the second state, the front layer 108 covers only one of the baby's shoulders. Further, the swaddle wrap of any embodiments disclosed herein can be configured such that, when the swaddle wrap 100 is in the first state before being used to cover the baby, no portion of the second portion 104 covers any portion of the first portion 102, such that, when the swaddle wrap 100 is in the first state before being used to cover the baby, the second portion 104 is positioned to a side of the first portion 102. Further, any embodiments of the swaddle wrap disclosed herein can be configured such that no portion of the front layer 114 of the second portion 104 is directly attached to any part of the first portion 102. In other embodiments, the swaddle wrap can be configured such that a portion of the front layer 114 of the second portion 104 is directly attached to or coupled with a portion of the first portion 102.

Further, the swaddle wrap of any embodiments disclosed herein can be configured such that, when the swaddle wrap 100 is positioned on a flat surface in a relaxed state before being used to cover the baby (i.e., in the first state) and the first portion 102 is positioned at an approximately 6 o'clock position with the front layer 108 facing away from the flat surface (i.e., such that a centerline going through a center of the first portion 102 points to the approximately 6 o'clock position), like the swaddle wrap 100 is shown in FIG. 1, the second portion 104 will be positioned at an approximately 8 o'clock position (i.e., such that a centerline going through a center of the second portion 104 points to the approximately 8 o'clock position). In some embodiments, when the swaddle wrap 100 is positioned on a flat surface in the relaxed state before being used to cover the baby and the first portion 102 is positioned at an approximately 6 o'clock position (as described above) with the front layer 108 facing away from the flat surface, the swaddle wrap 100 can be configured such that the second portion 104 will be positioned between and including an approximately 7 o'clock position and an approximately 10 o'clock position (i.e., such that a centerline going through a center of the second portion 104 points to between and including an approximately 7 o'clock position and an approximately 10 o'clock position.

Number of Steps:

Any of the embodiments of the swaddle wraps or methods of securing a swaddle wrap to a baby disclosed herein (including the embodiments of the swaddle wrap 100 disclosed herein) can be configured such that the swaddle wrap 100 can change from the first state in which no portion of the baby's body is covered by the swaddle wrap 100 to the second state in which the baby's body from at least the arms down is completely covered by the swaddle wrap 100, wherein the swaddle wrap 100 is secured to the baby's body in only two steps, or, in some embodiments, in three or less steps, or four or less steps. A first step of the two steps can include positioning the baby in the first enclosure 110 so that at least both of the baby's feet and one of the baby's shoulders are in the first enclosure 110, as shown in FIG. 3. A second step of the two steps can include positioning the second portion 104 over at least a portion of the baby so that at least both of the baby's feet and one of the baby's shoulders are in the second enclosure 116.

Further, in some embodiments, the swaddle wrap 100 can be configured to change from the first state in which no portion of the baby's body is covered by the swaddle wrap 100 to the second state in which the baby's body from at least the shoulders down is completely covered by the swaddle wrap 100 and the swaddle wrap 100 is secured to the baby's body in only two steps. Additionally, in some embodiments, the swaddle wrap 100 can be configured so that a user can completely cover the baby from at least the shoulders down and selectively secure the swaddle wrap 100 to the baby in only two steps, or, in some embodiments, in three or less steps, or four or less steps. A first step of the two steps can include positioning the baby in the first enclosure 110 so that at least both of the baby's feet and one of the baby's shoulders are in the first enclosure 110. A second step of the two steps can include positioning the second portion 104 over at least a portion of the baby so that at least both of the baby's feet and one of the baby's shoulders are in the second enclosure 116.

Some embodiments of the swaddle wraps disclosed herein can have a first portion 102 having a backing layer 106, a front layer 108, and a first enclosure 110 between the backing layer 106 and the front layer 108, and a second portion 104 coupled with the first portion 102, the second portion 104 having a backing layer 112, a front layer 114, and a second enclosure 116 between the backing layer 112 and the front layer 114 of the second portion 104. In some embodiments, the first enclosure 110 can be configured to secure the entire first portion 102 to the baby when at least a first shoulder 130 and the feet of the baby are in the first enclosure 110. Further, the second enclosure 116 can be configured to secure the entire second portion 104 to the baby when the second enclosure 116 covers at least a second shoulder 132 of the baby and at least the feet of the baby are in the second enclosure 116. Further, in any embodiments, the second enclosure 116 can be configured to cover the feet of the baby after the first enclosure 110 has covered the feet of the baby. As will be described, any embodiments of the swaddle wrap disclosed herein can include a third portion coupled with the first portion 102.

Figure 14:
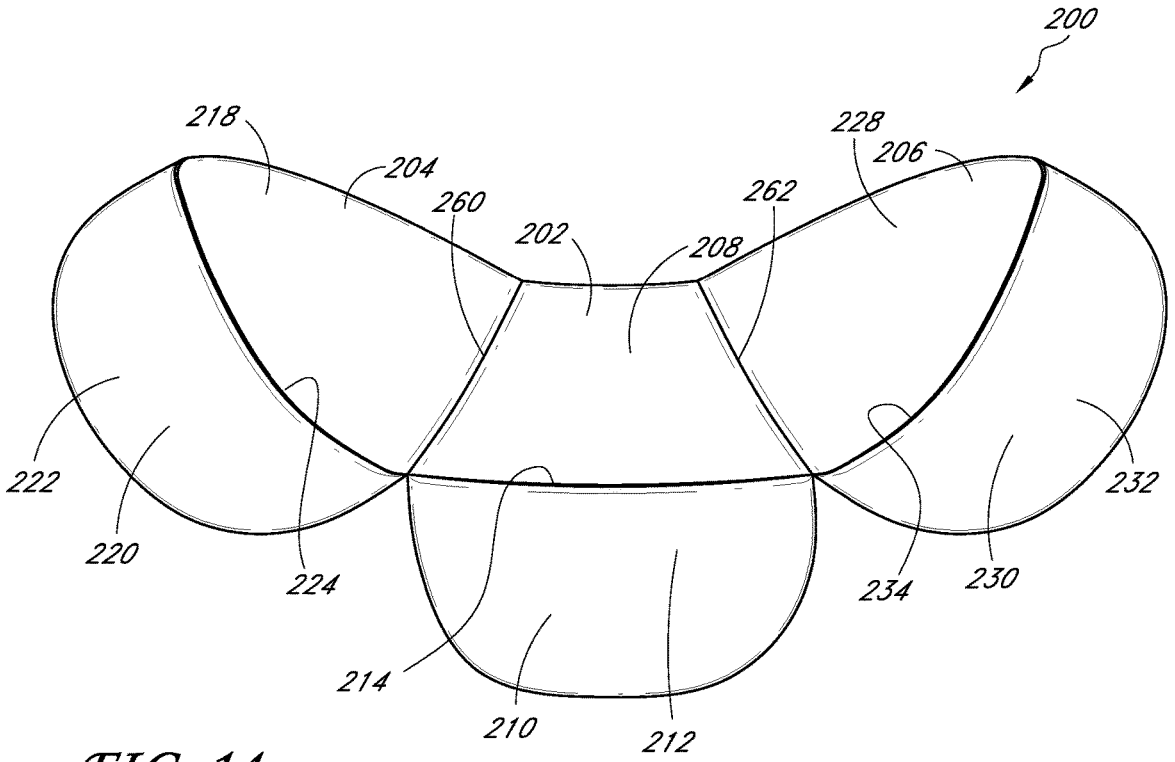
FIG. 14 shows a front view of another embodiment of a swaddle wrap in a first state, as if the swaddle wrap were resting on a planar surface.

Third Pouch:

Further, with reference to FIG. 14, any embodiments of the swaddle wraps disclosed herein can have a first portion 202, a second portion 204, and a third portion 206. The embodiment of the swaddle wrap 200 can have any of the features, components, and/or other details of any of the other swaddle wrap embodiments disclosed herein, including any of the embodiments of the swaddle wrap 100 disclosed above, in any combination with any of the features, components, and/or other details of any of the embodiments of the swaddle wraps 200 disclosed below. Additionally, any of the other swaddle wrap embodiments disclosed herein can have any of the features, components, and/or other details of any of the embodiments of the swaddle wrap 200 disclosed below in any combination with any of the features, components, and/or other details of any of other embodiments of the swaddle wraps disclosed herein.

The first portion 202 of the swaddle wrap 200 can have a backing layer 208, a front layer 210, and an enclosure 212 between the backing layer 208 and the front layer 210, the enclosure 212 having an opening 214 therein providing access to the enclosure 212. Similarly, the second portion 204 of the swaddle wrap 200 can have a having a backing layer 218, a front layer 220, and an enclosure 222 between the backing layer 218 and the front layer 220, the enclosure 222 having an opening 224 therein providing access to the enclosure 222. Further, the third portion 206 of the swaddle wrap 200 can have a backing layer 228, a front layer 230, and an enclosure 232 between the backing layer 228 and the front layer 230, the enclosure 232 having an opening 234 therein providing access to the enclosure 232. Additionally, in any embodiments, any of the first portion 202, second portion 204, and/or third portion 206, or any feature or portion thereof can be longer or larger or shaped differently to accommodate different sized babies. For example and without limitation, in some embodiments, the first portion 202 and/or the enclosure 212 of the first portion 202 can be longer so that, when the baby's legs are in the enclosure 212, the enclosure 212 can cover and enclose more of the baby's legs, or the entire length of the baby's legs.

Figure 15:
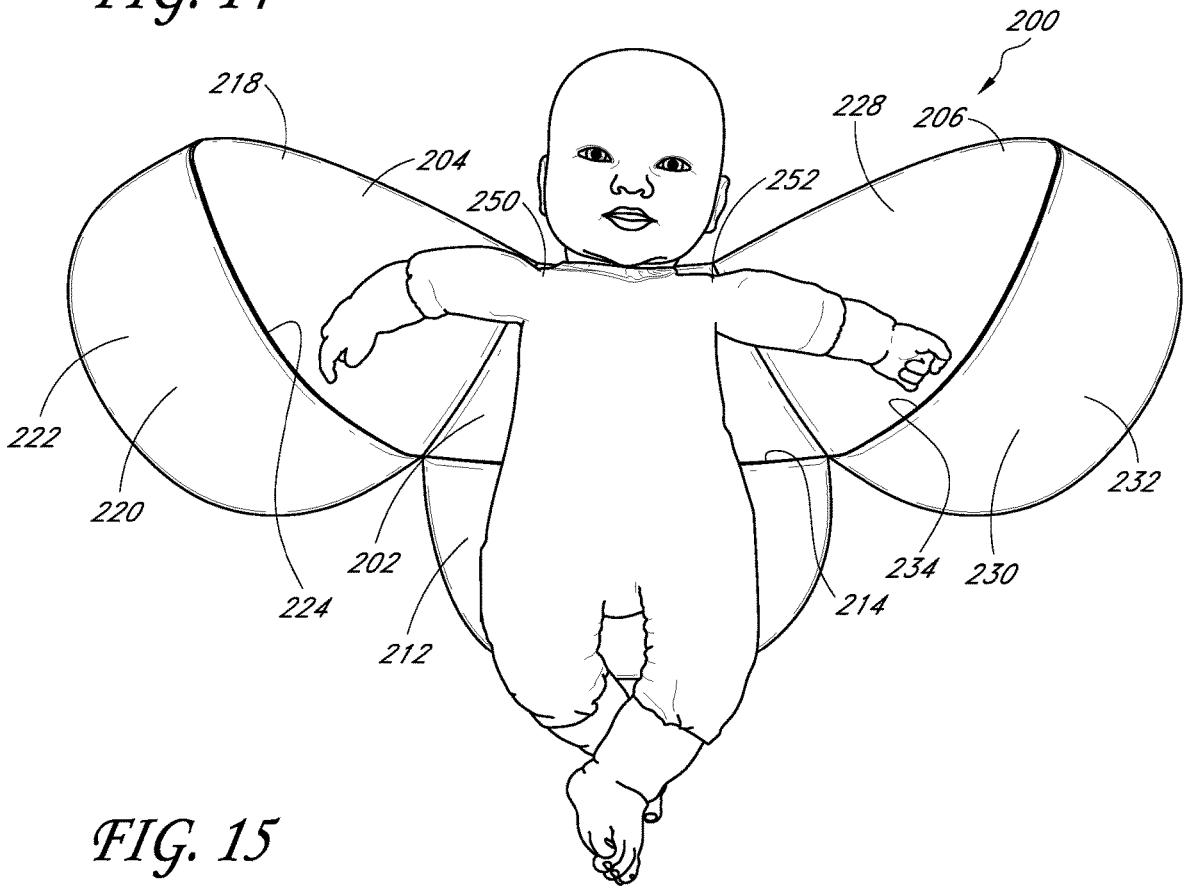
FIG. 15 shows a front view of the embodiment of the swaddle wrap shown in FIG. 14, with a baby positioned on a portion of the swaddle wrap.
Figure 16:
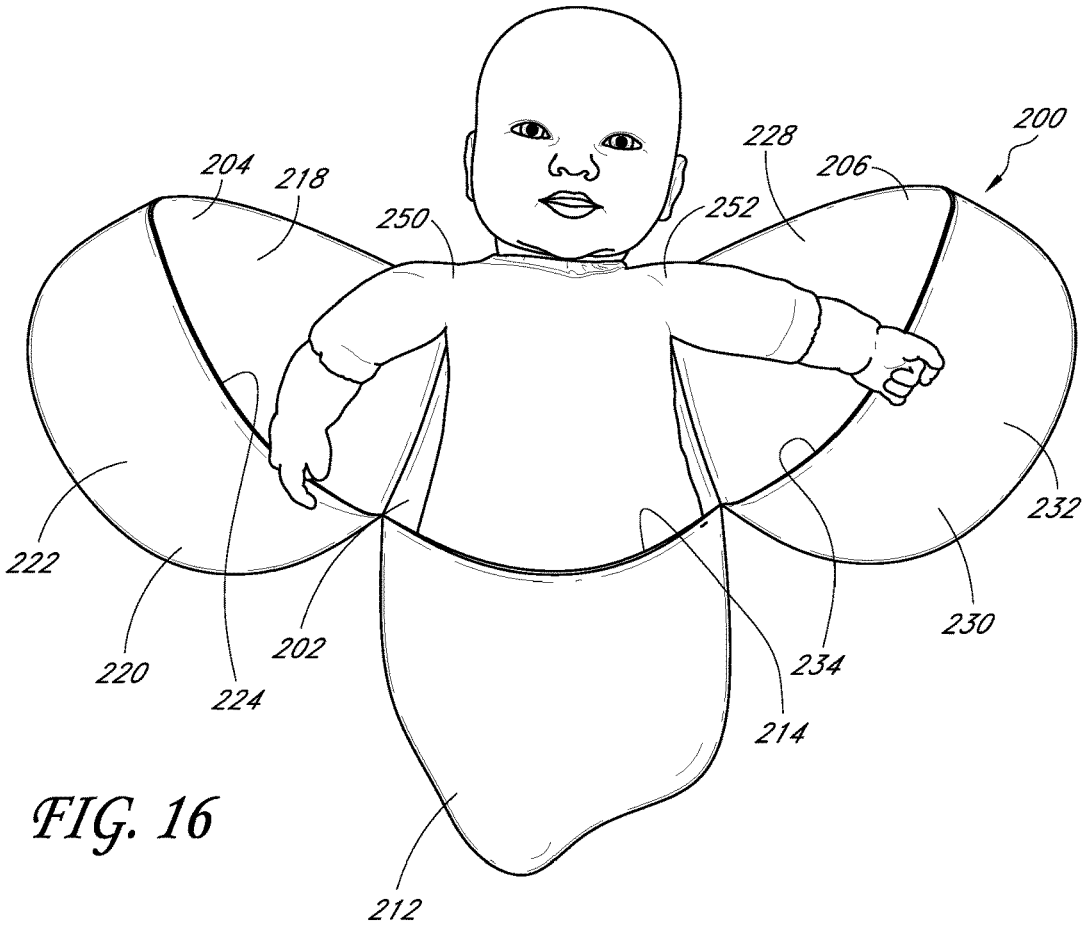
FIG. 16 shows a front view of the embodiment of the swaddle wrap shown in FIG. 14, with the baby's feet positioned in the first enclosure of the first portion of the swaddle wrap, and with the second portion and the third portion still in the first position.
Figure 17:
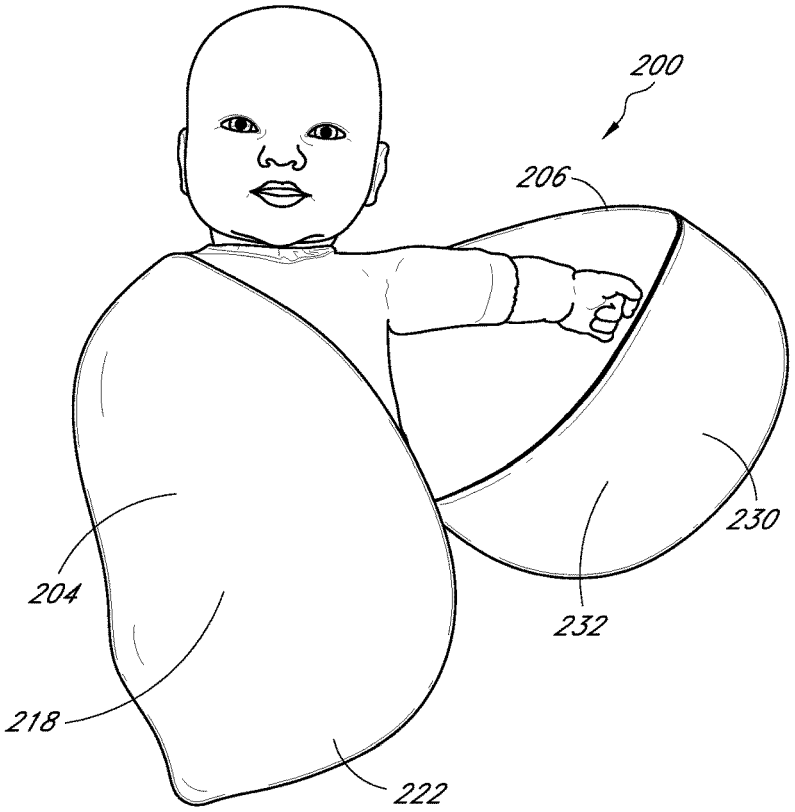
FIG. 17 shows a front view of the embodiment of the swaddle wrap shown in FIG. 14, showing the swaddle wrap after the second portion has been extended over the front of the baby and such that the second enclosure has been positioned over at least the baby's feet and a portion of the first portion so that at least the baby's feet and a portion of the first portion are positioned within the second enclosure.
Figure 18:
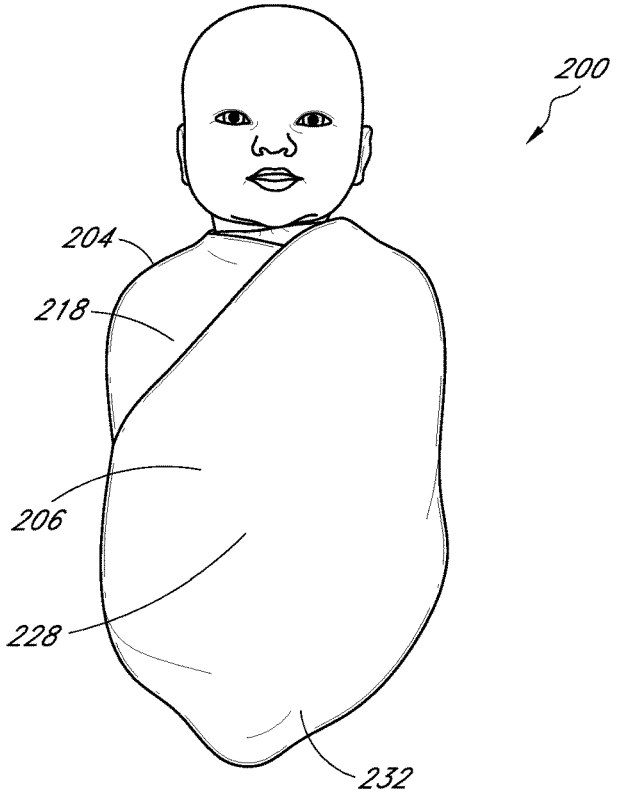
FIG. 18 shows a front view of the embodiment of the swaddle wrap shown in FIG. 14, showing the swaddle wrap in the second state, after the third portion has been extended over the front of the baby and such that the third enclosure has been positioned over at least the baby's feet and a portion of the first portion and the second portion so that at least the baby's feet and a portion of the first and second portions are positioned within the third enclosure.
Figure 19:
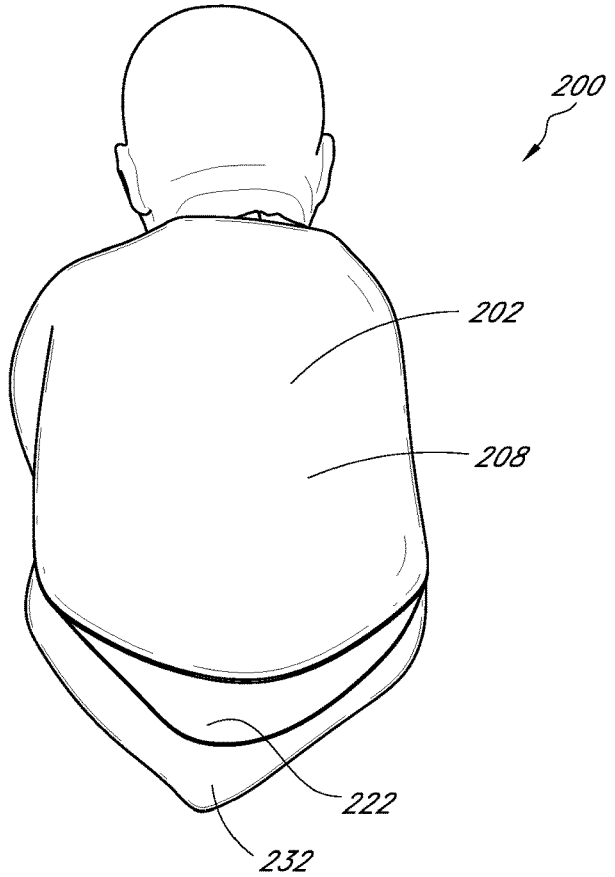
FIG. 19 shows a back view of the embodiment of the swaddle wrap shown in FIG. 14, showing the swaddle wrap in the second state.

The second portion 204 can be coupled with the first portion 202 on a first side of the first portion 202, and the third portion 206 can be coupled with the first portion 202 on a second side thereof. Any of the embodiments of the swaddle wraps or methods of securing a swaddle wrap to a baby disclosed herein can be configured to be moved from a first state wherein the swaddle wrap is not secured to the baby (as shown, for example, in FIGS. 14 and 15) to a second state wherein the first portion 202, the second portion 204, and the third portion 206 are secured to the baby (as shown in FIGS. 18 and 19).

In some embodiments, the swaddle wrap 200 can be configured such that, when the swaddle wrap 200 is in the first state before being used to cover the baby (as shown in FIG. 14), no portion of the second portion 204 or the third portion 206 covers any portion of the first portion 202. The swaddle wrap 200 can also be configured such that, when the swaddle wrap is in the first state before being used to cover the baby, the second portion 204 is positioned to a first side of the first portion 202 and the third portion 206 is positioned to a second side of the first portion 202, the second side of the first portion 202 being opposite to the first side of the first portion 202. In some embodiments, the second enclosure 222 can be configured to cover at least both feet of the baby in the second state, and the third enclosure 232 can also be configured to cover at least both feet of the baby in the second state.

Any of the embodiments of the swaddle wraps or methods of securing a swaddle wrap to a baby disclosed herein can be configured such that the first portion 202 has a first enclosure 212, as shown in the figures. In other embodiments, the first portion 202 can be configured to not have any pouches or enclosures therein. Further, in some embodiments, the second portion 204 can be configured to extend around at least the feet of the baby in the second state to secure the swaddle wrap to the baby's body in the second state, the second portion 204 can be configured to extend around at least one of the baby's shoulders (such as the first shoulder 250) and the baby's feet in the second state to secure at least the second portion 204 to the baby's body, the third portion 206 can be configured to extend around at least the feet of the baby in the second state to secure the third portion 206 to the baby's body in the second state, and/or the third portion 206 can be configured to extend around at least one of the baby's shoulders (such as the second shoulder 252) and the baby's feet in the second state to secure at least the third portion 206 to the baby's body. In any embodiments disclosed herein, the first portion 202 can be made without a pouch or enclosure. Further, in any embodiments disclosed herein, the swaddle wrap can be configured such that the second portion 204 encloses a portion of first portion 202, the third portion 206 encloses a portion of the first portion and/or the second portion 204, and/or the second portion 204 encloses a portion of the first portion 202 and/or the third portion 206.

Shoulder Coverage:

Any of the embodiments of the swaddle wraps or methods of securing a swaddle wrap to a baby disclosed herein can be configured such that the second portion 204 can cover a first shoulder but not a second shoulder of the baby when the second portion 204 is in the second state and the third portion 206 can be configured to cover the second shoulder but not the first shoulder of the baby when the third portion 206 is in the second state. Further, in some embodiments, the first portion 202 can be configured to not cover either the first shoulder or the second shoulder of the baby in the second state and/or the second portion 204 can be configured to cover a second shoulder of the baby in the second state so that a portion of the second portion 204 is positioned over the top of the baby's second shoulder and around the baby's second shoulder in the second state. Further, any embodiments of the swaddle wrap 200 can be configured such that the first portion 202 covers both shoulders of the baby and/or such that neither the second portion 204 nor the third portion 206 covers either shoulder of the baby. In any embodiments, the swaddle wrap 200 (or any other swaddle wrap embodiments disclosed herein) can be configured such that no portion of the swaddle wrap 200 goes over the baby's head during the process of covering the baby with the swaddle wrap.

Backing Layer:

With reference to FIG. 18, any of the embodiments of the swaddle wraps or methods of securing a swaddle wrap to a baby disclosed herein can be configured such that the backing layer 228 of the third portion 206 covers a substantial portion of the backing layer 218 of the second portion 204 in the second state. For example and without limitation, the backing layer 228 of the third portion 206 can be configured to cover a majority of the backing layer 218 of the second portion 204 in the second state, or to cover at least 75% of the backing layer 218 of the second portion 204 in the second state. Alternatively, any of the embodiments of the swaddle wraps or methods of securing a swaddle wrap to a baby disclosed herein can be configured such that the backing layer 218 of the second portion 204 covers a substantial portion of the backing layer 228 of the third portion 206 in the second state. For example and without limitation, the backing layer 218 of the second portion 204 can be configured to cover a majority of the backing layer 228 of the third portion 206 in the second state, or to cover at least 75% of the backing layer 228 of the third portion 206 in the second state.

In some embodiments, the second portion 204 and the third portion 206 can form a crisscross pattern over a front of the baby's body in the second state. Further, the second portion 204 can be configured to completely cover a first arm, both legs (or at least a front thereof), and both feet of the baby, and the third portion 206 can be configured completely cover a second arm, both legs (or at least a front thereof), and both feet of the baby in the second state. In some embodiments, the swaddle wrap 200 can be configured such that all three of the first portion 202, the second portion 204, and the third portion 206 can receive and at least partially cover at least the baby's legs and feet in the second state, and/or such that, in the second state, the first portion 202 can completely cover both legs and both feet of the baby, the second portion 204 can be configured to completely cover a first arm, both legs, and both feet of the baby, and the third portion 206 can be configured completely cover a second arm, both legs, and both feet of the baby. In some embodiments, the backing layers of the second portion 204 and third portion 206 can be configured to extend over a front of the baby's body in the second state, and/or such that the second portion 204 can be configured to move from a first position in the first state in which the backing layer 218 of the second portion 204 is in the same plane as the backing layer 208 of the first portion 202 to a second position in the second state in which the backing layer 218 of the second portion 204 crosses across the baby's body and the front layer 220 of the second portion 204 is in contact with the backing layer 208 of the first portion 202.

Seam:

Any of the embodiments of the swaddle wraps or methods of securing a swaddle wrap to a baby disclosed herein can be configured such that the first portion 202 is connected to the second portion 204 along a first connecting portion 260 and the first portion 202 is connected to the third portion 206 along a second connecting portion 262. The first connecting portion 260 can directly connect the backing layer 208 of the first portion 202 with the backing layer 218 of the second portion 204 and the second connecting portion 262 directly connects the backing layer 208 of the first portion 202 with the backing layer 228 of the third portion 206. In any embodiments, the first connecting portion 260 can be adjacent to a first shoulder and a first upper arm of the baby and a second connecting portion 262 can be adjacent to a second shoulder and second upper arm of the baby when the swaddle wrap 200 is in the second state. Further, in any embodiments disclosed herein, the swaddle wrap 200 can be configured and made such that the front and/or backing layer of the first portion, the second portion, and/or the third portion are made from a single and/or continuous piece of fabric, and/or so that there is no seam between the first and second portions on either or both of the front layer and the back layer of the first, second, and/or third portions.

Enclosures and Front Cover:

Any of the embodiments of the swaddle wraps or methods of securing a swaddle wrap to a baby disclosed herein can be configured such that the first portion 202 only has one opening therein, the opening being for the enclosure 212, and/or the second and third portions 204, 206 each only has one opening therein. Further, in any embodiments, the second enclosure 222 can be configured to receive therein a portion of the first portion 202 of the swaddle wrap in the second state and the third enclosure can be configured to also receive therein a portion of the first portion 202 of the swaddle wrap in the second state.

No Zippers, Knots, or Other Fasteners:

Any of the embodiments of the swaddle wraps or methods of securing a swaddle wrap to a baby disclosed herein can be configured such that the swaddle wrap can be secured to the baby without a use of zippers, snaps, ties, hook and loop fasteners, buttons, knots, magnets or other connectors or fasteners other than the second and third enclosures. In some embodiments, the swaddle wrap can be configured to be secured to the baby's body using only the second enclosure and the third enclosures 222, 232, the second and third backing layers 218, 228, and/or the first portion 202 (with or without an enclosure in the first portion). Further, in some embodiments, the swaddle wrap can be configured to be secured to the baby's body using only the first enclosure 212, the second enclosure 222, and the third enclosure 232.

Shape:

Any of the embodiments of the swaddle wraps or methods of securing a swaddle wrap to a baby disclosed herein can be configured such that when a baby is positioned in the swaddle wrap in the second state, the second portion 204 covers a first one of the baby's shoulders but not a second one of the baby's shoulders, and the third portion 206 covers the second one of the baby's shoulders but not the first one of the baby's shoulders. In any embodiments, the second portion can be the portion on either side of the first portion, and the third portion can be the portion on the other side of the first portion. Further, in any embodiments, the third portion can be wrapped around at least the baby's feet before the second portion, so that the second portion covers a portion of the third portion. In any embodiments disclosed herein, the second portion 204 can be sized, positioned, and connected to the first portion 202 such that, when a baby is positioned in the swaddle wrap in the second state, the second portion 204 covers a first one of the baby's shoulders but not a second one of the baby's shoulders, and the third portion 206 covers the second one of the baby's shoulders but not the first one of the baby's shoulders. Further, in any embodiments disclosed herein, the first portion 202, the second portion 204, and/or the third portion 206 can have a curved bottom edge. In any embodiments, each of the first portion 202, the second portion 204, and the third portion 206 can have a pouch sized and configured to cover at least both feet of a baby.

In some embodiments, the swaddle wrap 200 can be configured such that no portion of the front layer of the second portion 204 or the third portion 206 is directly attached to any part of the first portion 202. In other embodiments, a portion of the front layer of the second portion 204 and/or the third portion 206 can be directly attached to a portion of the first portion 202. The backing layers 218, 228 of the second and third portions can be directly connected to the first portion 202 or formed from a single and/or continuous piece of material or fabric so that there is no connection or seam between the first, second, and/or third portions. Further, the swaddle wrap 200 can be configured such that, when the swaddle wrap is positioned on a flat surface in a relaxed state before being used to cover the baby and the first portion 202 is positioned at an approximately 6 o'clock position with the front layer facing away from the flat surface (i.e., such that a centerline going through a center of the first portion 202 points to the approximately 6 o'clock position), the second portion 204 can be positioned at an approximately 8 o'clock position (i.e., such that a centerline going through a center of the second portion 204 points to the approximately 8 o'clock position), and the third portion 206 will be positioned at an approximately 4 o'clock position (i.e., such that a centerline going through a center of the third portion 206 points to the approximately 4 o'clock position), or the second portion 204 will can positioned between and including an approximately 7 o'clock position and an approximately 10 o'clock position (i.e., such that a centerline going through a center of the second portion 204 points to between and including an approximately 7 o'clock position and an approximately 10 o'clock position) and the third portion 206 will be positioned between and including an approximately 2 o'clock position and an approximately 5 o'clock position (i.e., such that a centerline going through a center of the third portion 206 points to between and including an approximately 2 o'clock position and an approximately 5 o'clock position).

Additionally, in any embodiments disclosed herein, the first, second, and/or third portions of the swaddle wrap can be similarly sized and/or shaped, or can be the same size and/or shape. In other embodiments, either the first or the second portion of the swaddle wrap can be larger than the other portion of the swaddle wrap. In some embodiments, a first portion of the swaddle wrap can be a mirror image of the second portion and/or the third portion of the swaddle wrap.

Number of Steps:

Any of the embodiments of the swaddle wraps (including, without limitation, swaddle wrap 200) or methods of securing a swaddle wrap to a baby disclosed herein can be configured such that the swaddle wrap can change from the first state in which no portion of the baby's body is covered by the swaddle wrap to the second state in which the baby's body from at least the arms down is completely covered by the swaddle wrap and the swaddle wrap is securable to the baby's body in only three steps. In any embodiments, the swaddle wrap can be configured to change from the first state in which no portion of the baby's body is covered by the swaddle wrap to the second state in which the baby's body from at least the shoulders down is completely covered by the swaddle wrap and the swaddle wrap is secured to the baby's body in only three steps. In some embodiments, at least one of the three steps can include positioning the baby's body on the first portion 202 of the swaddle wrap, at least one of the three steps can include extending the second portion 204 over at least a portion of the baby so that a first one of the baby's shoulders is covered by the second portion 204 and at least both of the baby's feet are in the second enclosure 222, and/or at least one of the three steps can include positioning the third portion 206 over at least a portion of the baby so that a second one of the baby's shoulders is covered by the third portion 206 and at least both of the baby's feet are in the third enclosure 232. In some embodiments, extending the second and/or third portions over the baby's shoulders and/or extending the enclosures of the second and/or third portions across the body of the baby and around the baby's legs and feet can help secure the swaddle wrap to the baby.

Fabric:

In any of the embodiments of the swaddle wraps, methods of securing a swaddle wrap to a baby, or garments (including the embodiments of the garments 300 and 400 disclosed herein), such swaddle wrap and garment embodiments can be made from a fabric material, including a stretchable or semi-stretchable fabric material. A jersey-knit material may be used. In some embodiments, at least a portion of the swaddle wrap and/or garment can be made from or with a blend of cotton, spandex, polyester, rayon, and/or any other suitable fabric or material. In any embodiments disclosed herein, at least a portion of the swaddle wrap (for example and without limitation, the portion(s) of the swaddle wrap configured to surround a baby's feet and/or legs) and/or any desired portion of the garment can be made from a mesh material or a lightweight, more porous material. This can allow that portion of the swaddle wrap and/or garment to maintain a cooler temperature even with multiple layers of material overlapping. Any embodiments of the swaddle wrap and/or garments disclosed herein can have invisible seams, be reversible (with or without a different type of fabric on each side), and/or any other features typical of gender specific or unisex garment designs.

Further, in any embodiments disclosed herein, the swaddle wrap can be configured to have more space within the swaddle wrap to accommodate one or both of the baby's shoulders. This can make the swaddle wrap more comfortable and provide a more snug and more anatomical fit over the baby's shoulders. In some embodiments, this can be achieved by providing more material in the front and/or backing layers of the first portion, the second portion, and/or the third portion that the baby's shoulders can be received in or that can surround the baby's shoulders without stretching the material around the shoulders more than other portions of the swaddle wrap.

Methods of Use:

In any of the embodiments of the methods of securing a swaddle wrap to a baby disclosed herein can include at least partially covering the baby (for example and without limitation, the baby's feet and/or legs) with a first portion of the swaddle wrap, wherein the first portion of the swaddle wrap can have a first pouch and the swaddle wrap can have a second portion that is coupled with the first portion of the swaddle wrap, and the second portion having a second pouch, positioning at least both feet of the baby within the first pouch of the first portion of the swaddle wrap, at least partially covering the baby with the second portion of the swaddle wrap, covering at least one of the baby's shoulders with the second portion of the swaddle wrap, and extending the second pouch over at least the baby's feet and a portion of the first pouch of the first portion of the swaddle wrap so that at least both feet of the baby and a portion of the first pouch of the first portion of the swaddle wrap are positioned within the second pouch of the swaddle wrap. In any embodiments disclosed herein, the first portion of the swaddle wrap can be configured to not have a pouch or enclosure, and/or be configured to not enclose the baby's feet or legs.

In any of the embodiments of the methods of securing a swaddle wrap to a baby disclosed herein, the method can include positioning the baby in the first portion of the swaddle wrap so that a first shoulder of the baby is positioned within the first pouch of the first portion of the swaddle wrap. Further, in some embodiments, securing the second portion of the swaddle wrap to the baby can include covering a second shoulder of the baby with the second portion of the swaddle wrap. In some embodiments, securing a swaddle wrap to a baby can be achieved with only the following steps: covering at least a portion of a first shoulder of the baby with the first portion of the swaddle wrap, positioning at least both feet of the baby within the first pouch of the first portion of the swaddle wrap, covering at least a portion of a second shoulder of the baby with the second portion of the swaddle wrap, and extending the second pouch over at least the baby's feet and a portion of the first pouch of the first portion of the swaddle wrap so that at least both feet of the baby and a portion of the first pouch of the first portion of the swaddle wrap are positioned within the second pouch of the swaddle wrap.

In some embodiments, the swaddle wrap can be configured such that the first portion of the swaddle wrap does not cover any portion of the second shoulder of the baby. For such embodiments, securing a swaddle wrap to a baby can be achieved with only the following steps: covering at least a portion of a first shoulder of the baby with the first portion of the swaddle wrap, covering at least a portion of a second shoulder of the baby with the second portion of the swaddle wrap, and extending the second pouch over at least the baby's feet so that at least both feet of the baby are positioned within the second pouch of the swaddle wrap.

In any of the embodiments of the methods of securing a swaddle wrap to a baby disclosed herein can include at least partially covering the baby (for example and without limitation, the baby's feet and/or legs) with a first portion of the swaddle wrap, wherein the first portion of the swaddle wrap can have a first pouch, the swaddle wrap can have a second portion that is coupled with the first portion of the swaddle wrap and which has a second pouch, the swaddle wrap can have a third portion that is coupled with the first portion of the swaddle wrap and which has a third pouch, positioning at least both feet of the baby within the first pouch of the first portion of the swaddle wrap, covering at least one of the baby's shoulders with the second portion of the swaddle wrap, extending the second pouch over at least the baby's feet and a portion of the first pouch of the first portion of the swaddle wrap so that at least both feet of the baby and a portion of the first pouch of the first portion of the swaddle wrap are positioned within the second pouch of the swaddle wrap, and/or covering a second of the baby's shoulders with the third portion of the swaddle wrap, extending the third pouch over at least the baby's feet and a portion of the first pouch of the first portion and a portion of the second pouch of the second portion so that at least both feet of the baby and a portion of the first pouch of the first portion of the swaddle wrap are positioned within the third pouch of the swaddle wrap. In any embodiments disclosed herein, the first portion of the swaddle wrap can be configured to not have a pouch or enclosure, and/or be configured to not enclose the baby's feet or legs, wherein the steps related to covering a portion of the first pouch would not be performed.

In any of the embodiments of the methods of securing a swaddle wrap to a baby disclosed herein, the method can include positioning the baby in the first portion of the swaddle wrap, extending a second portion of the swaddle wrap over the baby so that a first shoulder of the baby is positioned within the second pouch of the second portion of the swaddle wrap, and extending a third portion of the swaddle wrap over the baby such that a second shoulder of the baby is covered with the third portion of the swaddle wrap. In some embodiments, securing a swaddle wrap to a baby can be achieved with only the following steps: covering at least a portion of a first shoulder of the baby with a portion of the swaddle wrap, positioning at least both feet of the baby within a pouch of the a portion of the swaddle wrap, covering at least a portion of a second shoulder of the baby with another portion of the swaddle wrap, and extending a pouch over at least the baby's feet so that at least both feet of the baby are positioned within the pouch of the swaddle wrap.

The garments and methods of securing a garment to a person of this disclosure each have many innovative aspects, implementations, or aspects, no single one of which is solely responsible for the desirable attributes disclosed herein. With reference to FIGS. 20A-25, any embodiments of the garments disclosed herein can have a body portion 302, a first flap portion 304, and a second flap portion 306. The embodiment of the garment 300 can have any of the features, components, and/or other details of any of the other garment embodiments disclosed herein, including any of the embodiments of the garment 100 disclosed above, in any combination with any of the features, components, and/or other details of any of the embodiments of the garments 300 disclosed below. Additionally, any of the other garment embodiments disclosed herein can have any of the features, components, and/or other details of any of the embodiments of the garment 300 disclosed below in any combination with any of the features, components, and/or other details of any of other embodiments of the garments disclosed herein. Any embodiments of the garment 300 disclosed herein can be used to dress or clothe at least an upper body of a person 301 without a use of any zippers, snaps, ties, hook and loop fasteners, buttons, knots, or other removable or disconnectable connectors or fasteners. Additionally, any embodiments of the garment 300 disclosed herein can be used to dress or clothe at least an upper body of a person 301 without having to pass any portion of the garment over a head of the person or without forming a continuous, uninterrupted or non-openable enclosure around a neck of the person.

In some embodiments, the body portion 302 of the garment 300 can have a first arm portion 308 and a second arm portion 310 having first and second armholes 309, 311, respectively, configured to receive the first and second arms 303, 305 of the person 301. The first and second arm portions 308, 310 can be coupled with or positioned at an upper portion 302*a* of the body portion 302. In some embodiments, the first and second arm portions 308, 310 can be integrally formed with the other features and portions of the body portion 302. The first arm portion 308 can have a first armhole 309 and the second arm portion 310 can have a second armhole 311. Additionally, the body portion 302 of the garment 300 can have a first leg portion 316 and a second leg portion 318 configured to receive the first and second legs 317, 319 of the person 301. The first leg portion 316 can have a first leghole 320 that the person's first leg can be received in and passed through and the second leg portion 318 can have a second leghole 322 that the person's second leg can be received in and passed through. The first and second leg portions 316, 318 can be coupled with or positioned at a lower portion 302*b* of the body portion 302. In some embodiments, the first and second leg portions 316, 318 can be integrally formed with the other features and portions of the body portion 302.

In some embodiments, the first and second arm portions 308, 310 can be positioned on, coupled with, or integrally formed with the first and second flap portions 304, 306, respectively. In other embodiments, the garment 300 can be made without any arm portions. Additionally, in some embodiments, the body portion 302 and garment 300 can be made without having a first or a second leg portion. In this configuration, the lower portion 302*b* of the body portion 302 can be configured to wrap around a backside of the person's body after the first and second flap portions 304, 306 are secured to the body.

A proximal end portion 304*a* of the first flap portion 304 can be connected to the body portion 302 along a first seam 326, and a proximal end portion 306*a* of the second flap portion 306 can be connected to the body portion 302 along a second seam 328. The first flap portion 304 of the garment 300 can have a first loop element 330 at or near a distal end 304*b* thereof, the loop element 330 having a first opening 332 therein. The second flap portion 306 of the garment 300 can have a second loop element 334 at or near a distal end 306*b* thereof, the loop element 334 having a second opening 336 therein. Additionally, in other embodiments, at least one of the body portion 302, the first flap portion 304, and the second flap portion 306 can be made from a continuous, uninterrupted piece of material such that there are no seams between the body portion 302 and at least one of the first flap portion 304 and the second flap portion 306 on an inside surface or layer of the garment 300 and/or on an outside surface or layer of the garment 300.

Figure 20A:
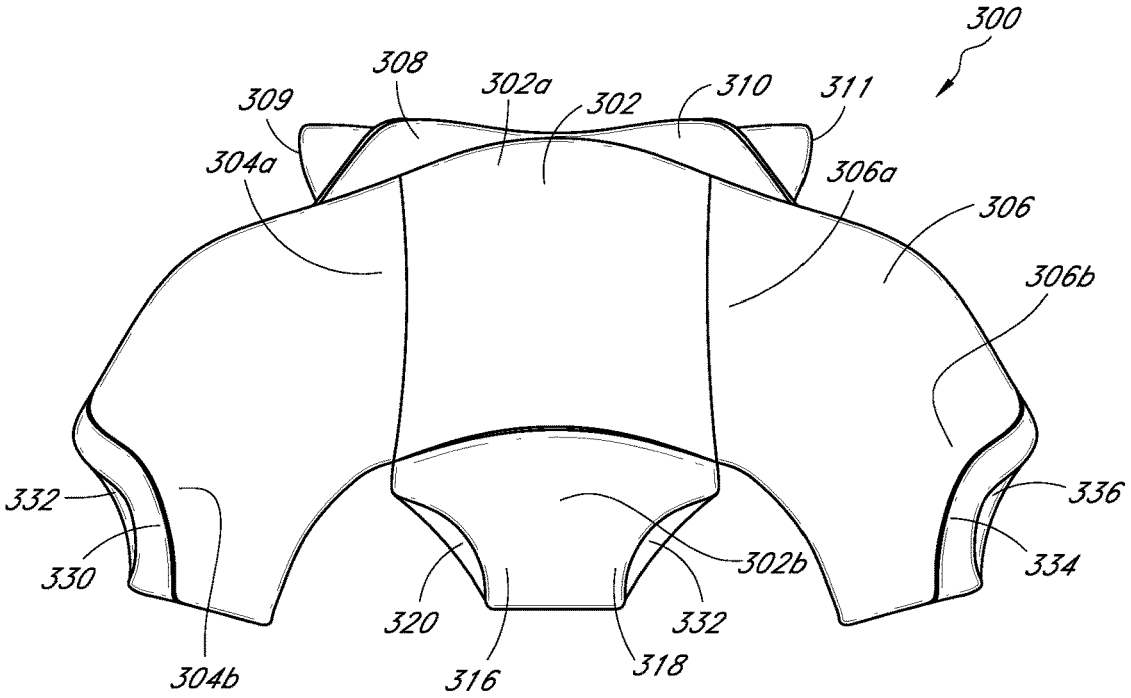
FIG. 20A shows a front view of another embodiment of a garment in a first state on a planar surface.
Figure 20B:
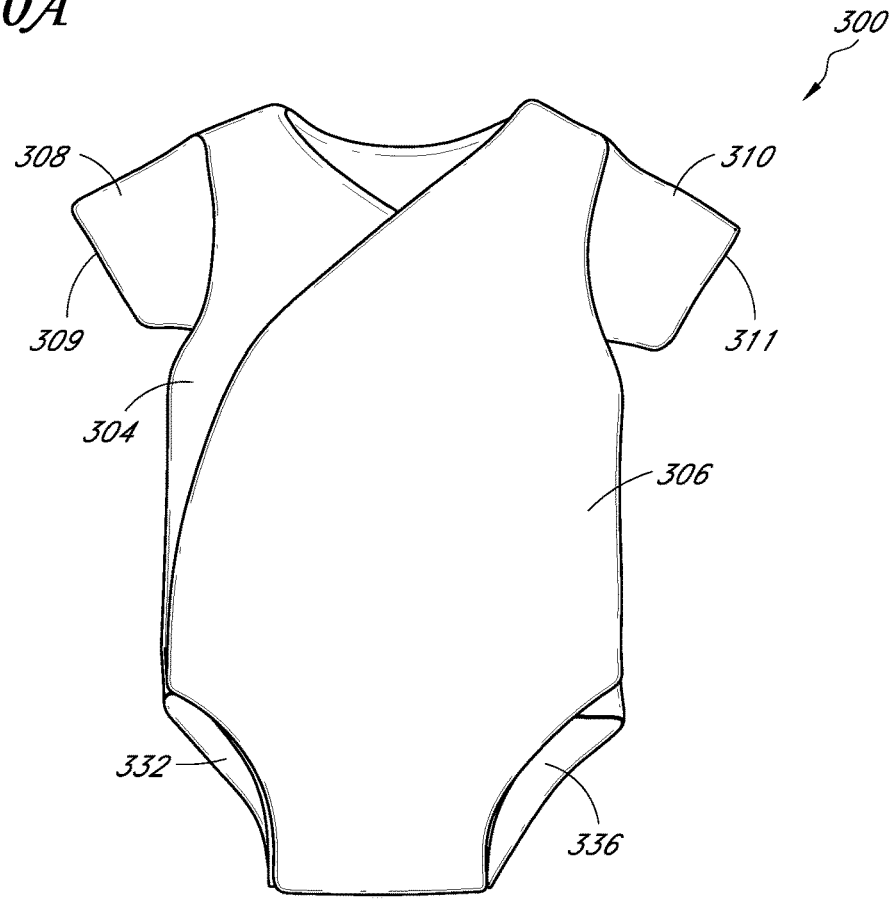
FIG. 20B shows a front view of the embodiment of the garment shown in FIG. 19, with garment in a second state on a planar surface.
Figure 21:
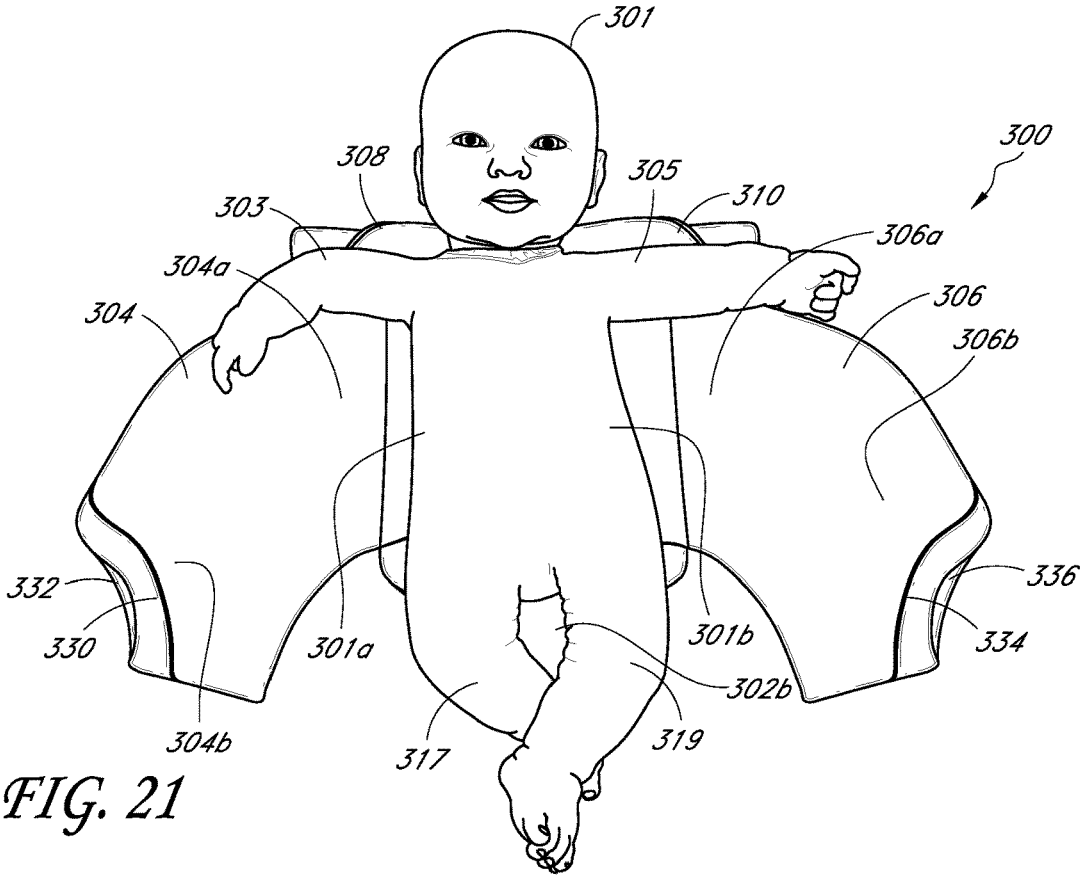
FIG. 21 shows a front view of the embodiment of the garment shown in FIG. 20A, with a person positioned on a portion of the garment.
Figure 22:
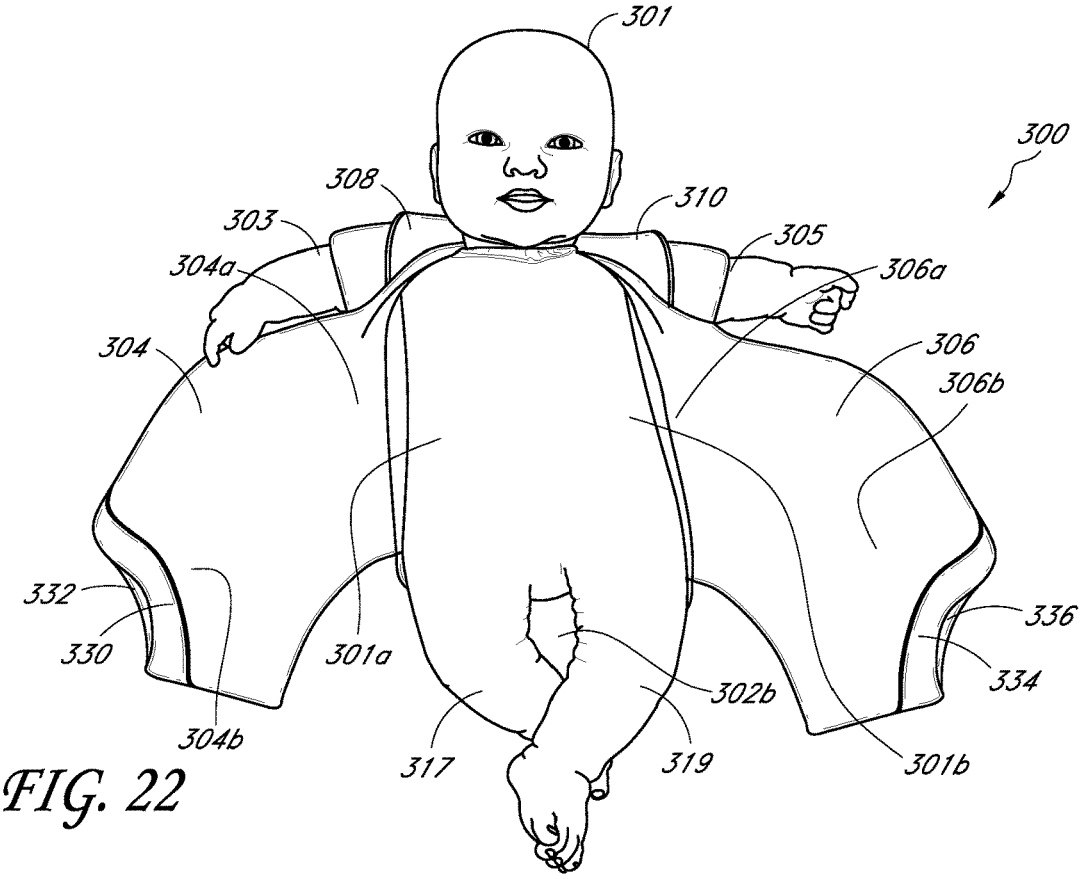
FIG. 22 shows a front view of the embodiment of the garment shown in FIG. 20A, with the person's arms positioned in the first and second arm portions of the garment, and with the first flap portion and the second flap portion still in the first position.
Figure 23:
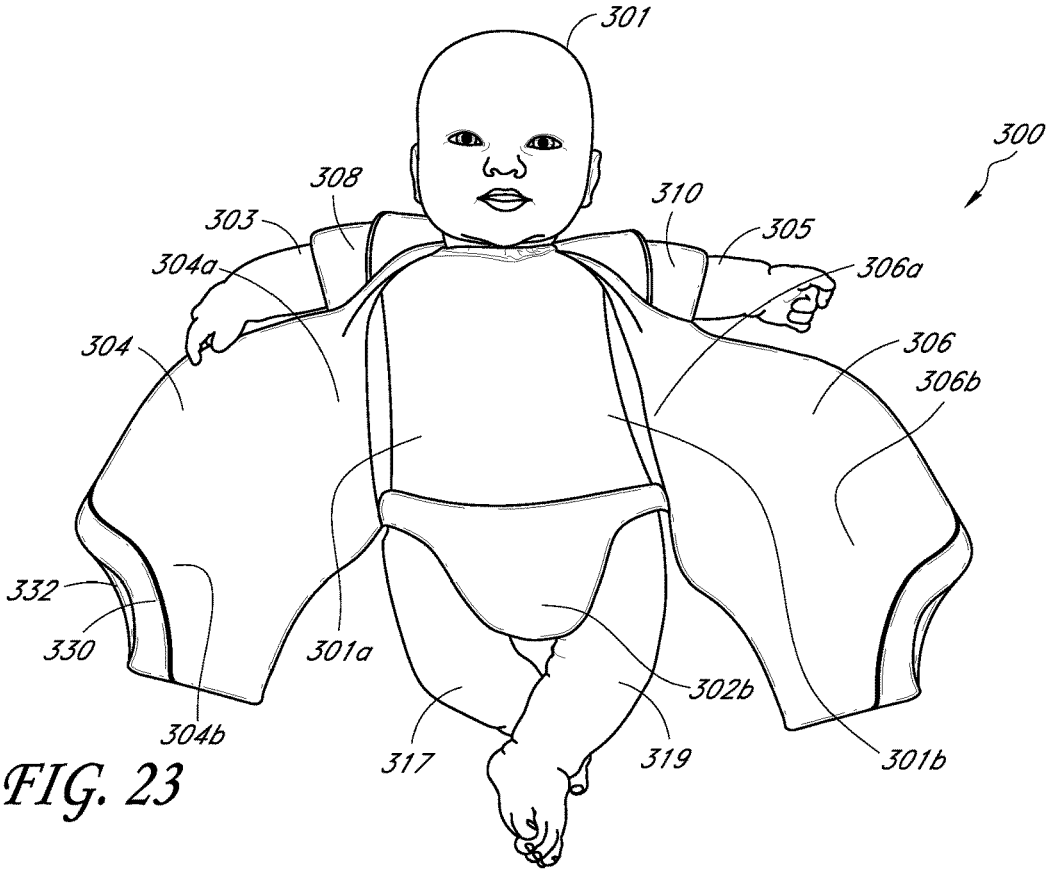
FIG. 23 shows a front view of the embodiment of the garment shown in FIG. 20A, with the person's arms positioned in the first and second arm portions of the garment, the person's legs positioned in the first and second leg portions of the body portion of the garment, and with the first flap portion and the second flap portion still in the first position.
Figure 24:
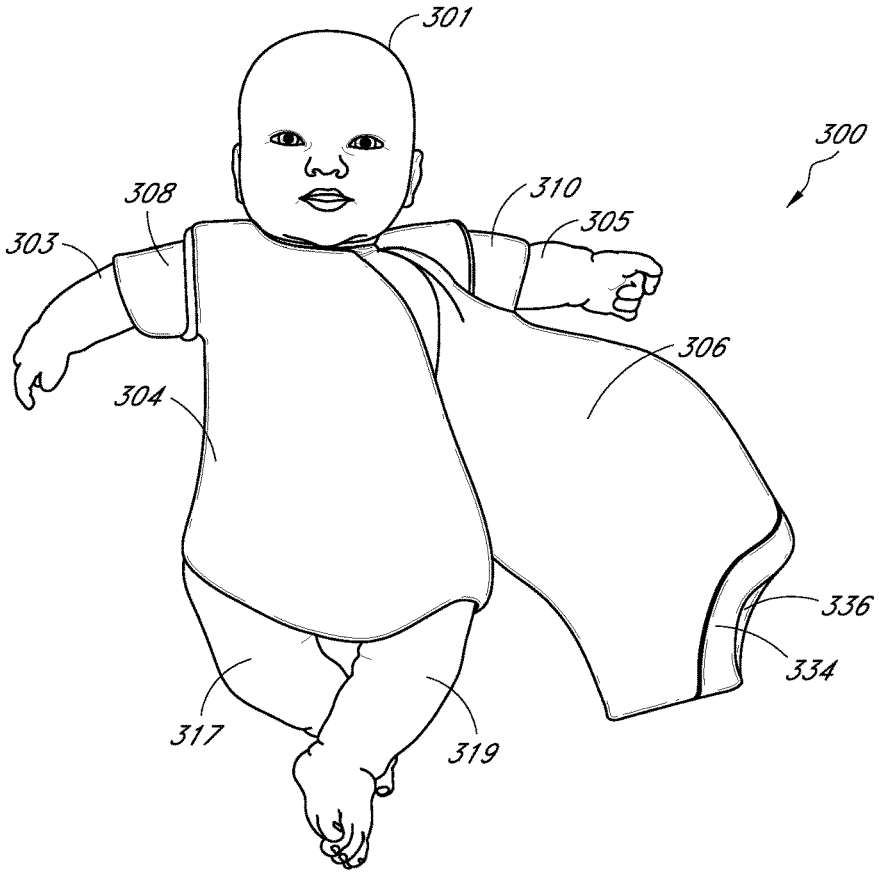
FIG. 24 shows a front view of the embodiment of the garment shown in FIG. 20A, showing the garment after the first flap portion has been extended over the front of the person and wherein the first loop element has been positioned over at least one of the person's legs.
Figure 25:
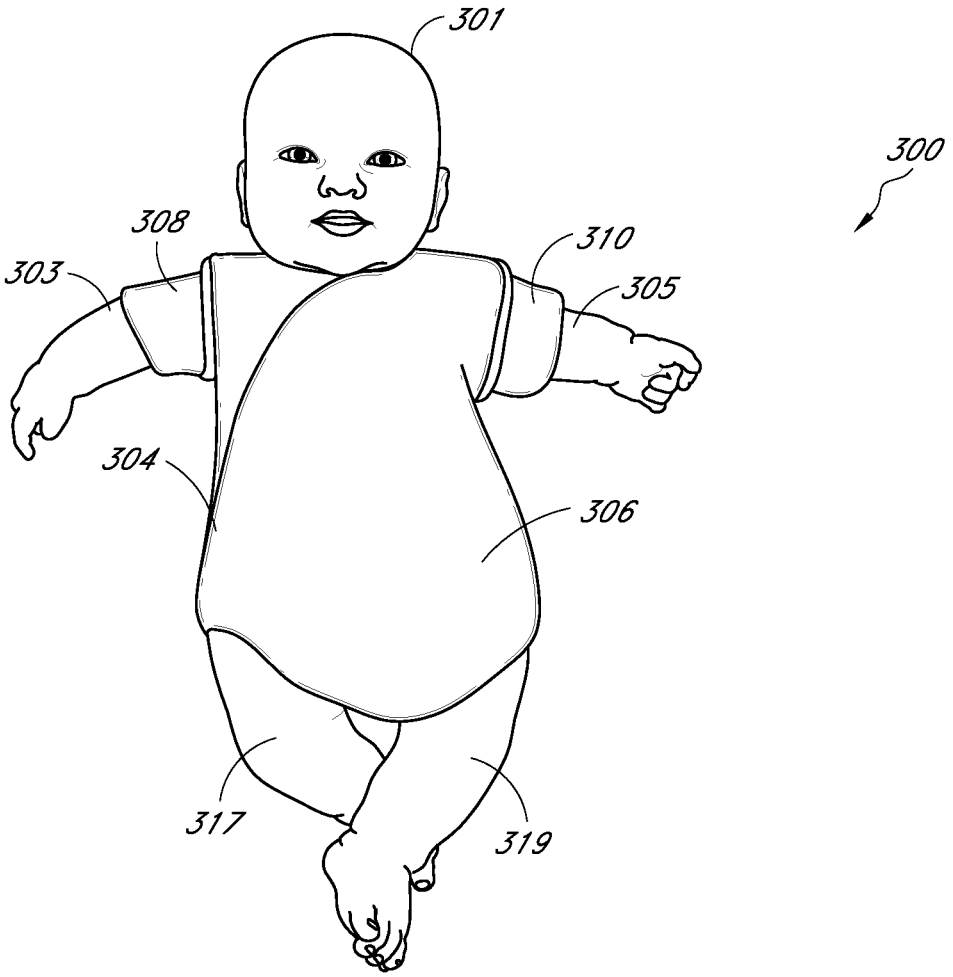
FIG. 25 shows a front view of the embodiment of the garment shown in FIG. 20A, showing the garment after the second flap portion has been extended over the front of the person and wherein the second loop element has been positioned over at least one of the person's legs.

Any of the embodiments of the garments or methods of securing a garment to a person disclosed herein can be configured to be moved from a first state wherein the garment is not secured to the person (i.e., where the person is not dressed with the garment, as shown, for example, in FIG. 20A) to a second state wherein person is fully dressed by the garment 300 and the body portion 302, the first flap portion 304, and the second flap portion 306 are secured to the person (as shown in FIG. 25).

In some embodiments, the garment 300 can be configured such that, when the garment 300 is in the first state before being used to cover the person, no portion of the first flap portion 304 or the second flap portion 306 covers any portion of the body portion 302 (as shown in FIG. 20A). The garment 300 can also be configured such that, when the garment is in the first state before being used to cover the person, the first flap portion 304 is positioned to a first side of the body portion 302 and the second flap portion 306 is positioned to a second side of the body portion 302, the second side of the body portion 302 being opposite to the first side of the body portion 302.

The first flap portion 304 can be configured to extend across a front of the person's body (i.e., wrap across a front of the person's body) so that the first loop element 330 can be advanced over the second leg of the person to secure at least the first flap portion 304 to the user's body. For example and without limitation, the first flap portion 304 can be stretched or extended across the person's body from a first side 301*a* of the person's body 301 toward a second side 301*b* of the person's body 301 so that the second leg 319 on the second side 301*b* of the person's body can be passed through the first leghole 332 of the first loop portion 330. Similarly, the second flap portion 306 can be configured to extend across a front of the person's body (i.e., wrap across a front of the person's body) so that the second loop element 334 can be advanced over the first leg 317 of the person 301 to secure at least the second flap portion 306 to the user's body. For example and without limitation, the second flap portion 306 can be stretched or extended across the person's body from a second side 301*b* of the person's body 301 toward a first side 301*a* of the person's body 301 so that a first leg 317 on the first side 301*a* of the person's body 301 can be passed through the second leghole 336 of the second loop portion 334.

With reference to FIG. 25, any of the embodiments of the garments or methods of securing a garment to a person disclosed herein can be configured such that the second flap portion 306 covers a substantial portion of the first flap portion 304 in the second state (or, in other embodiments, vice-versa). For example and without limitation, the second flap portion 306 can be configured to cover a majority of the first flap portion 304 in the second state, or to cover at least 75% of the first flap portion 304 in the second state. In some embodiments, the first flap portion 304 and the second flap portion 306 can form a crisscross pattern over a front of the person's body in the second state.

No Zippers, Knots, or Other Fasteners:

Any of the embodiments of the garments or methods of securing a garment to a person disclosed herein can be configured such that the garment can be secured to the person without a use of zippers, snaps, ties, hook and loop fasteners, buttons, knots, or other removable or disconnectable connectors or fasteners other than the first and second arm portions 308, 310 (and first and second armholes 309, 311), the first and second loop elements 330, 334, and the first and second leg portions 316, 318, which some embodiments of the garment 300 can have. In some embodiments, the garment can be configured to be secured to the person's body using only the first and second arm portions 308, 310 (and first and second armholes 309, 311), the first and second loop elements 330, 334, and/or the first and second leg portions 316, 318.

Fabric:

In any of the embodiments of the garments, swaddle wraps, or methods of securing the garment to a person disclosed herein, the garment can be made from any suitable material, including a stretchable or semi-stretchable fabric material. A jersey-knit material may be used. In some embodiments, at least a portion of the garment can be made from cotton, spandex, polyester, and/or any other suitable fabric or material. Some embodiments can have elastic in certain portions of the garment, such as through leg holes (if any), arm holes, around the waist, or otherwise, which can improve the fit and/or the securement of the garment to the body. In other embodiments, the garment may be made intentionally without elastic to provide a looser fit to the body.

In any embodiments disclosed herein, at least a portion of the garment can be made from a mesh material or a lightweight, more breathable material. This can allow that portion of the garment to maintain a cooler temperature even with multiple layers of material overlapping. Additionally, in any embodiments, one or more portions of the garment (or, in some embodiments, the entire garment) can be made from insulated fabric or contain insulation and/or padding for extra warmth and comfort. For example and without limitation, some embodiments of the garment can have wool, fleece, or other padded or insulative material.

Sleeves:

In any embodiments, the garment can have ruffles and/or other decorative features. Further, some embodiments of the garment can have invisible seams, be reversible, have short sleeves, long sleeves, tank sleeves, a skirt, shorts, pants, and/or any other features typical of gender specific or unisex garment designs.

Method of Use:

In any embodiments, the garment can be configured to change from the first state in which no portion of the person's body is covered by the garment to the second state in which at least an upper body portion of the person's body (including a portion of the arms such as with a short sleeve, all of the arms such as with a long sleeve, or otherwise) is completely or substantially completely covered by the garment and the garment is secured to the person's body.

Some embodiments of methods of securing a garment (such as any embodiments of the garment 300 disclosed herein) to a person disclosed herein can include at least partially covering a back of the person with the body portion 302 of the garment 300, at least partially covering a front of the person with a first flap portion 304 that can be coupled with the body portion 302 by extending the first flap portion 304 over a front of the person, and securing a distal end portion 304*b* of the first flap portion 304 to at least one of the person's legs to secure the first flap portion 304 to the person. Some embodiments can also include extending a second flap portion 306 that can be coupled with the body portion 302 over the front of the person to completely cover the front of the person, and securing a distal end portion 306*b* of the second flap portion 306 to at least one of the person's legs to secure the second flap portion 306 to the person.

In any embodiments, the user can also secure at least a lower portion 302*b* of the body portion 302*b* to the body of the person P by securing the lower portion 302*b* of the body portion 302 to the person's legs. The user can also, in some embodiments, secure at least a lower portion 302*b* of the body portion 302 to the body of the person by advancing one of the person's legs through a first leghole 320 that can be in the body portion 302, and/or by advancing a second one of the person's legs through a second leghole 322 that can be in the body portion 302. Further in some embodiments, the user can secure at least a portion of the garment 300 to the body of the person by securing an upper portion of the garment to the person's arms. For example and without limitation, the user can secure at least an upper portion of the garment 300 to the body of the person by advancing one of the person's arms through a first armhole 309 that can be in the garment 300 and/or by advancing a second one of the person's arms through a second armhole 311 that can be in the garment 300. In any embodiments, the first and second armholes can be in the body portion, can be in the first and second flap portions (respectively), can be part of the body portion and the first and second flap portions (respectively), or otherwise. In any embodiments disclosed herein, the garment can be configured to be applied to the person's body without forming a continuous, uninterrupted or non-openable enclosure around a neck of the person, and/or without going over a head of the person.

With reference to FIGS. 26-30, any embodiments of the garments disclosed herein (including, without limitation, the garment 400) can have a body portion 402, a first flap portion 404, and a second flap portion 406. Note that, in any embodiments, either of the flap portions can be the first flap portion, and the second flap portion can be the other flap portion. Any embodiments of the garment 400 can have any of the features, components, and/or other details of any of the other garment embodiments disclosed herein, including any of the embodiments of the garment 300 disclosed above, in any combination with any of the features, components, and/or other details of any of the embodiments of the garments 400 disclosed below. Additionally, any of the other garment embodiments disclosed herein, including the embodiments of the garment 300, can have any of the features, components, and/or other details of any of the embodiments of the garment 400 disclosed below in any combination with any of the features, components, and/or other details of any of other embodiments of the garments disclosed herein. Any embodiments of the garment 400 disclosed herein can be used to dress or clothe at least an upper body of a person 401 without a use of any zippers, snaps, ties, hook and loop fasteners, buttons, knots, or other removable or disconnectable connectors or fasteners. Additionally, any embodiments of the garment 400 disclosed herein can be used to dress or clothe at least an upper body of a person 401 without having to pass any portion of the garment over a head of the person or without forming a continuous, uninterrupted or non-openable enclosure around a neck of the person.

In some embodiments, the body portion 402 of the garment 400 can have a first armhole 408 and a second armhole 410 configured to respectively receive the first and second arms 403, 405 of the person 401. The first and second armholes 408, 410 can be coupled with or positioned at an upper portion 402*a* of the body portion 402. In some embodiments, the first and second armholes 408, 410 can be integrally formed with the other features and portions of the body portion 402.

In some embodiments, the first and second flap portions 404, 406 can be formed from the same piece of fabric as the body portion 402. In other embodiments, a proximal end portion 404*a* of the first flap portion 404 can be connected to the body portion 402 along a first seam between the first flap portion and the body portion (not shown), and a proximal end portion 406*a* of the second flap portion 406 can be connected to the body portion 402 along a second seam between the second flap portion and the body portion. Further, the first flap portion 404 of the garment 400 can have a first arm portion 430 at or near a distal end 404*b* of the first flap portion 404, the arm portion 430 having a third opening 432 therein. The second flap portion 406 of the garment 400 can have a second arm portion 434 at or near a distal end 406*b* of the second flap portion 406, the arm portion 434 having a fourth opening 436 therein. In some embodiments, the arm portion 434 can have a seam 435 therein so that the garment will look approximately symmetric at or near the first and second arm portions 430, 434 when the garment 400 is in the second state. In some embodiments, the garment 400 can be configured to appear symmetric about a centerline when the garment 400 is in the second state.

In some embodiments, the first and second arm portions 430, 434 can be positioned on, coupled with, or integrally formed with the first and second flap portions 404, 406, respectively. The first and second arm portions 430, 434 can have short sleeves, long sleeve, half-length sleeves, or no sleeves at all (such as in, for example, a tank top design). Additionally, in some embodiments, the first and second arm portions 430, 434 can have ruffles and/or other decorative features, such as decorative buttons to hold the sleeve in a rolled up position, but which buttons are not used to secure the garment to the person's body. Additionally, some embodiments of the garment can have invisible seams, be reversible, and/or have any other features typical of gender specific or unisex garment designs. Additionally, in any embodiments disclosed herein, the body portion 402, the first flap portion 404, and/or the second flap portion 404 can have one or more looping elements or leg portions configured to secure the garment to the person's legs, just like in any of the other embodiments disclosed above.

Figure 26:
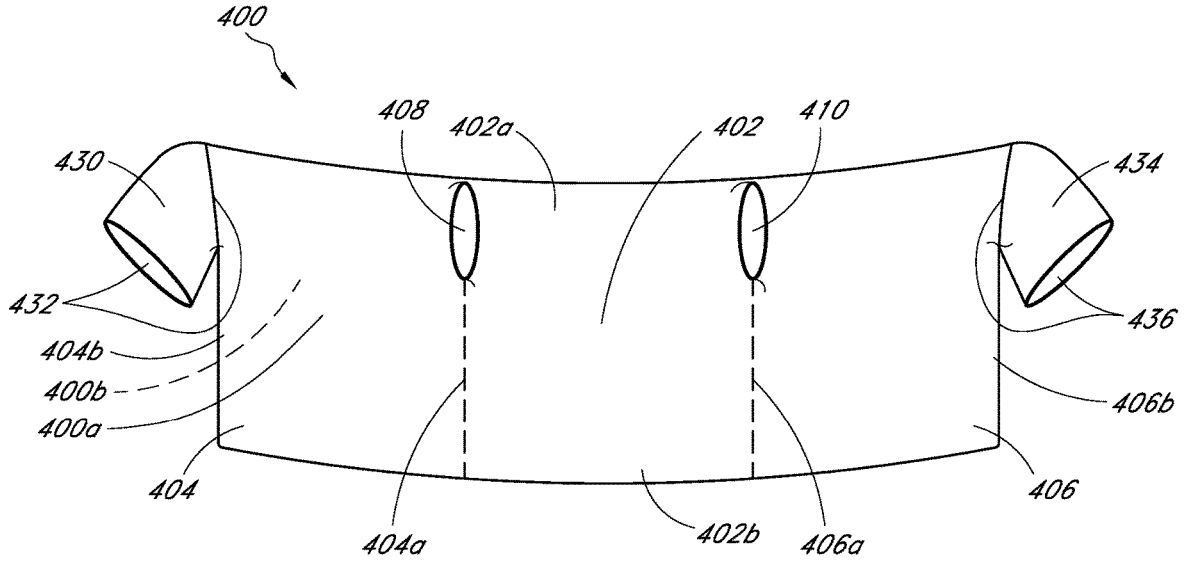
FIG. 26 shows a front view of another embodiment of a garment in a first state on a planar surface.
Figure 30:
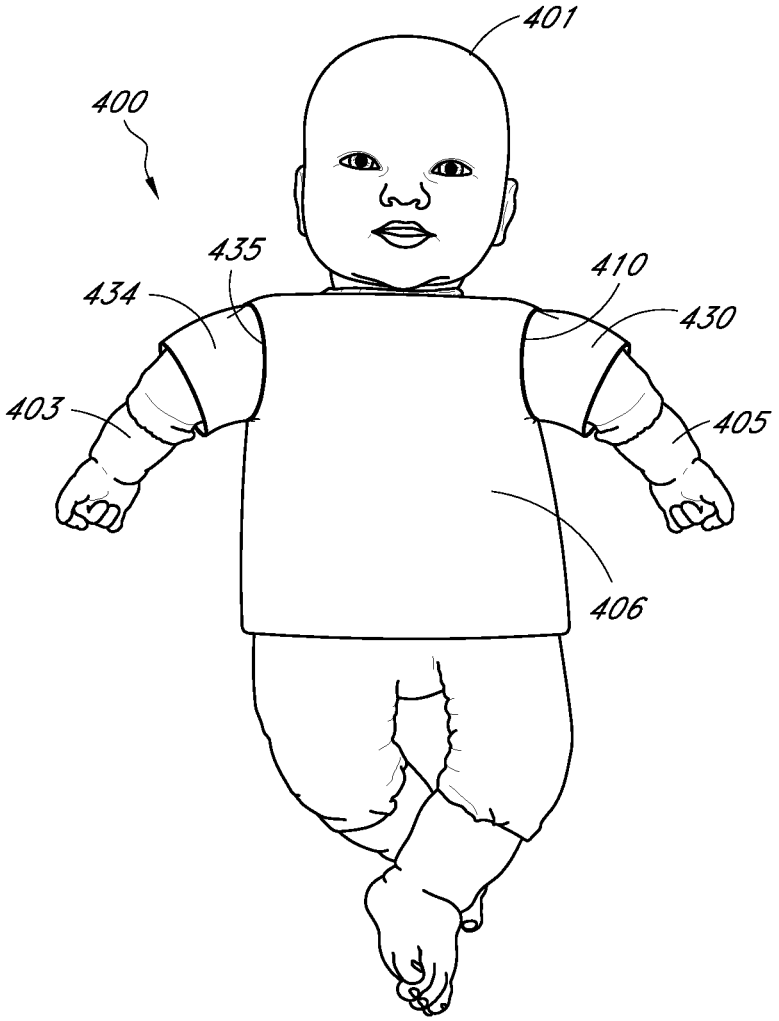
FIG. 30 shows a front view of the embodiment of the garment shown in FIG. 26, showing the garment in the second state after the second flap portion has been extended over the front of the person and wherein the person's first arm has been passed through a fourth armhole of a second arm portion of the garment.

Any of the embodiments of the garments or methods of securing a garment to a person disclosed herein can be configured to be moved from a first state wherein the garment is not secured to the person (i.e., where the person is not dressed with the garment, as shown, for example, in FIG. 26) to a second state wherein person is fully dressed by the garment 400, and the body portion 402, the first flap portion 404, and the second flap portion 406 are secured to the person (as shown in FIG. 30).

Figure 29:
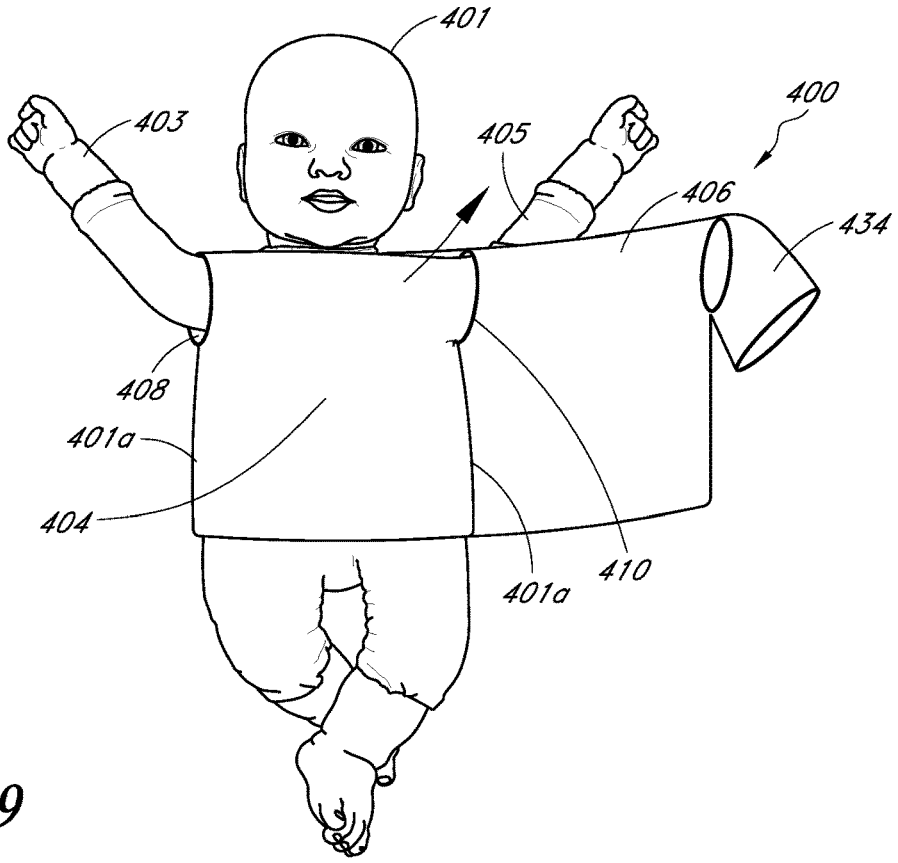
FIG. 29 shows a front view of the embodiment of the garment shown in FIG. 26, showing the garment after the person's second arm has been passed through the second armhole in the garment.

In some embodiments, the garment 400 can be configured such that, when the garment 400 is in the first state before being used to cover the person, no portion of the first flap portion 404 or the second flap portion 406 covers any portion of the body portion 402 (as shown in FIG. 29-30). The garment 400 can also be configured such that, when the garment is in the first state before being used to cover the person, the first flap portion 404 is positioned to a first side of the body portion 402 and the second flap portion 406 is positioned to a second side of the body portion 402, the second side of the body portion 402 being opposite to the first side of the body portion 402.

The first flap portion 404 can be configured to extend across a front of the person's body (i.e., wrap across a front of the person's body) in the second state so that the first arm portion 430 can be passed over the second arm 405 of the person to secure at least the first flap portion 404 to the user's body. For example and without limitation, the first flap portion 404 can be stretched or extended across the person's body from a first side 401*a* of the person's body 401 toward a second side 401*b* of the person's body 401 so that the second arm 405 on the second side 401*b* of the person's body can be passed through the first armhole 432 of the first arm portion 430. Similarly, the second flap portion 406 can be configured to extend across a front of the person's body (i.e., wrap across a front of the person's body) so that the second arm portion 434 can be passed over the first arm 403 of the person 401 to secure at least the second flap portion 406 to the user's body. For example and without limitation, the second flap portion 406 can be stretched or extended across the person's body from a second side 401*b* of the person's body 401 toward a first side 401*a* of the person's body 401 so that a first arm 403 on the first side 401*a* of the person's body 401 can be passed through the second armhole 436 of the second arm portion 434.

With reference to FIGS. 29-30, any of the embodiments of the garments or methods of securing a garment to a person disclosed herein can be configured such that the first flap portion 404 and/or the second flap portion 406 covers a substantial portion of a front of the person's upper body in the second state. With reference to FIG. 30, any of the embodiments of the garments or methods of securing a garment to a person disclosed herein can also be configured such that the second flap portion 406 covers a substantial portion of the first flap portion 404 in the second state. For example and without limitation, in some embodiments, the second flap portion 406 can be configured to cover a majority of the first flap portion 404 in the second state, or to cover at least approximately 75% of the first flap portion 404, or at least approximately 85% of the first flap portion 404, in the second state. In some embodiments, the first flap portion 404 and the second flap portion 406 can form a crisscross pattern over a front of the person's body in the second state. Either the first or the second flap portions 404, 406 can be positioned under or be covered by the other of the first and the second flap portions 404, 406. For example, any of the embodiments of the garments or methods of securing a garment to a person disclosed herein can also be configured such that the first flap portion 404 covers a substantial portion of the second flap portion 406 in the second state. For example and without limitation, in some embodiments, the first flap portion 404 can be configured to cover a majority of the second flap portion 406 in the second state, or to cover at least approximately 75% of the second flap portion 406, or at least approximately 85% of the second flap portion 406, in the second state.

No Zippers, Knots, or Other Fasteners:

Any of the embodiments of the garments or methods of securing a garment to a person disclosed herein can be configured such that the garment can be secured to the person without a use of zippers, snaps, ties, hook and loop fasteners, buttons, knots, or other removable or disconnectable connectors or fasteners other than the first and second armholes 408, 410 and/or the first and second arm portions 430, 434 (having third and fourth armholes 432, 434), which some embodiments of the garment 400 can have. In some embodiments, the garment can be configured to be secured to the person's body using only the first and second armholes 408, 410 and/or the first and second arm portions 430, 434 (having third and fourth armholes 432, 434).

Fabric:

In any of the embodiments of the garments or methods of securing the garment to a person disclosed herein, the garment can be made from any suitable material, including a stretchable or semi-stretchable fabric material. A jersey-knit material may be used. In some embodiments, at least a portion of the garment can be made from cotton, spandex, polyester, and/or any other suitable fabric or material. In any embodiments disclosed herein, at least a portion of the garment can be made from a mesh material or a lightweight, more breathable material. This can allow that portion of the garment to maintain a cooler temperature even with multiple layers of material overlapping. Additionally, in any embodiments, one or more portions of the garment (or, in some embodiments, the entire garment) can be made from insulated fabric or contain insulation and/or padding for extra warmth and comfort. For example and without limitation, some embodiments of the garment can have wool, fleece, or other padded or insulative material.

Method of Use:

In any embodiments, the garment can be configured to change from the first state in which no portion of the person's body is covered by the garment to the second state in which at least an upper body portion of the person's body (including a portion of the arms such as with a short sleeve garment, all of the arms such as with a long sleeve garment, or otherwise) is completely or substantially completely covered by the garment and the garment is secured to the person's body.

Figure 27:
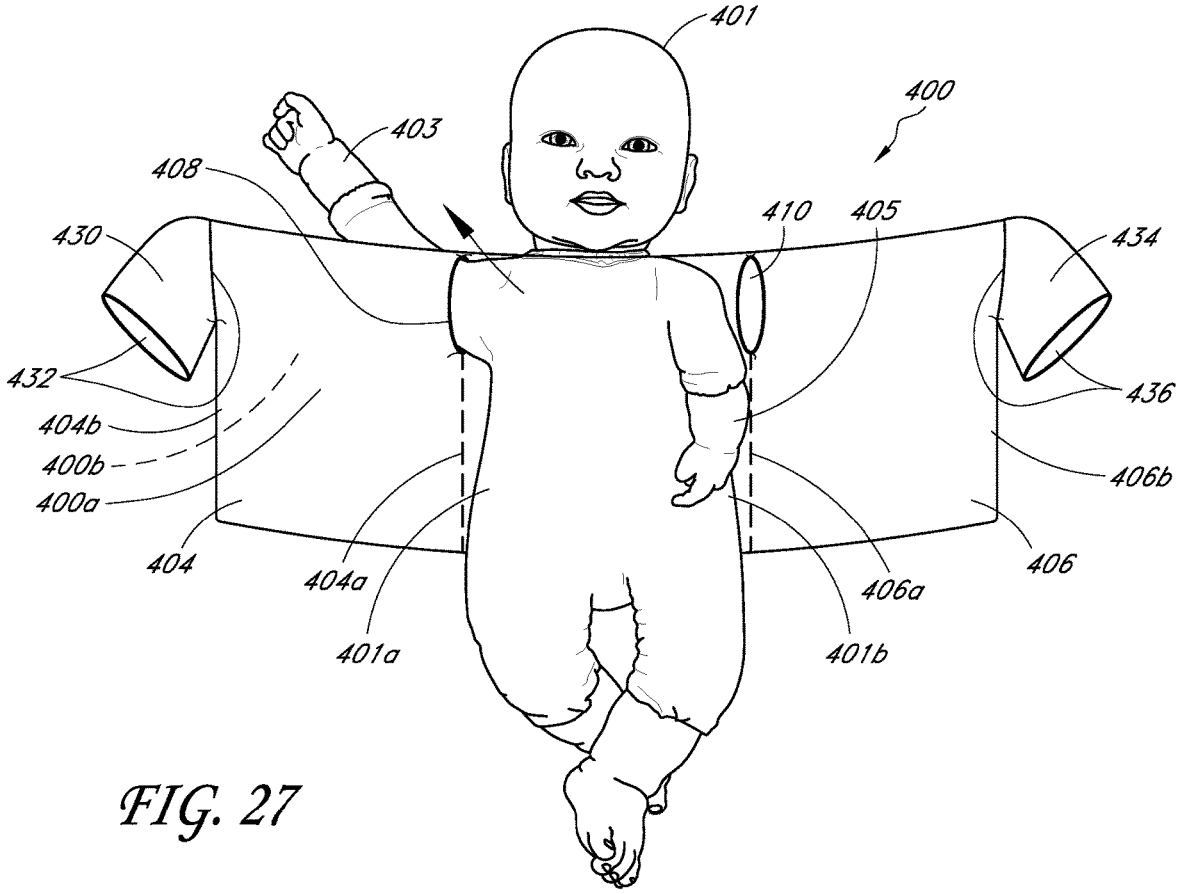
FIG. 27 shows a front view of the embodiment of the garment shown in FIG. 26, with a person positioned on a portion of the garment and showing a first arm of the person passed through a first armhole of the garment, while the second arm of the person has not been passed through a second hole of the garment yet.
Figure 28:
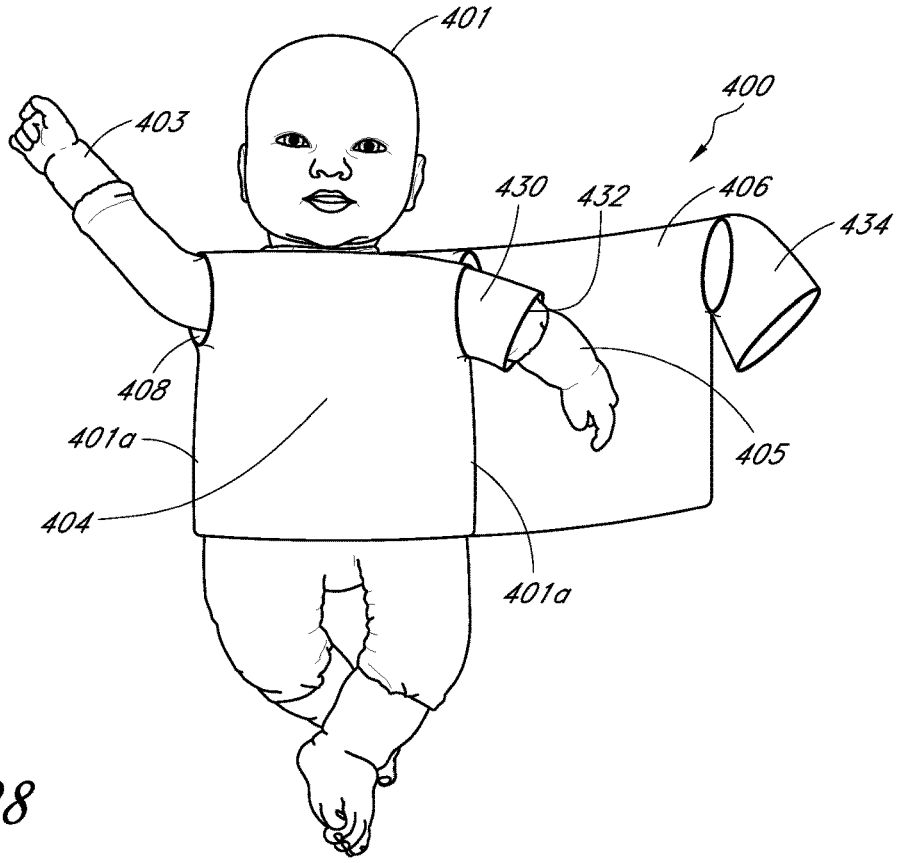
FIG. 28 shows a front view of the embodiment of the garment shown in FIG. 26, showing the garment after the first flap portion has been extended over the front of the person and wherein the person's second arm has been passed through a third armhole of a first arm portion of the garment.

With reference to FIG. 27, the body portion 402 can remain against the person's back while the user's first arm 403 is passed through the first armhole 408 from an inside surface 400*a* of the garment and past the outside surface 400*b* of the garment 400. Thereafter, with reference to FIG. 28, the first flap portion 404 can be extended or moved across a front of the person's body so that the second arm 405 of the person can be passed through the third armhole 432 of the first arm portion 430 to cover a front of the person's body and to secure the first flap portion 404 to the person's upper body. Thereafter, as shown in FIG. 29, the person's second arm 405, having the first arm portion 430 over at least a proximal portion of the person's second arm 405 and/or over and around the person's second shoulder, can be passed through the second armhole 410 from an inside surface 400*a* of the garment and past the outside surface 400*b* of the garment 400.

Thereafter, with reference to FIG. 30, the second flap portion 406 can be extended or moved across a front of the person's body so that the first arm 403 of the person can be passed through the fourth armhole 436 of the second arm portion 434 to cover a front of the person's body (and, in some embodiments, the first flap portion 404) and to secure the second flap portion 406 to the person's upper body.

Some embodiments of methods of securing a garment to a person disclosed herein (such as any embodiments of the garment 400 disclosed herein) can include at least partially covering a back of the person with the body portion 402 of the garment 400, at least partially covering a front of the person with a first flap portion 404 that can be coupled with the body portion 402 by extending the first flap portion 404 over a front of the person, and securing a distal end portion 404*b* of the first flap portion 404 to at least one of the person's arms to secure the first flap portion 404 to the person. Some embodiments can also include extending a second flap portion 406 that can be coupled with the body portion 402 over the front of the person to completely cover the front of the person, and securing a distal end portion 406*b* of the second flap portion 406 to at least one of the person's arms to secure the second flap portion 406 to the person.

In any embodiments, the user can also secure at least a lower portion 402*b* of the body portion 402*b* of the body portion 402 to the body of the person P by securing the lower portion 402*b* of the body portion 402 to the person's legs using one or more openings, loops, straps, or otherwise. The user can also, in some embodiments, secure at least a lower portion 402*b* of the body portion 402 to the body of the person by advancing one of the person's legs through a first leg portion or a first leghole (not shown, but similar to the leg portions and legholes of any of the embodiments of the garment 300 described above) that can be in the body portion 402, and/or by advancing a second one of the person's legs through a second leg portion or a second leghole (not shown, but similar to the leg portions and legholes of any of the embodiments of the garment 300 described above) that can be in the body portion 402.

In any embodiments disclosed herein, including without limitation the embodiments of the swaddle wrap 100, the swaddle wrap 200, the garment 300, and/or the garment 400, the designation of first and second as used herein is not meant to denote the left or the right arm, leg, or side of the body. It is meant to denote either the left or the right arm, the left or the right leg, and/or the left side or the right side of the body. Also, the designation of first and second as used herein is not meant to denote the left or right armhole in particular, the left or right leghole in particular, or the left or right side or flap in particular of the embodiment. It is meant to denote either the left or the right armhole (either one), the left or the right leg hole (either one), the left or the right flap (either one), etc. As an example, the first arm can be either the person's left arm or the person's right arm. The first armhole can be (if applicable) can be configured to receive either the person's left arm or the person's right arm, the first leg hole (if applicable) can be configured to receive either the person's left leg or the person's right leg, etc.

While certain embodiments of the inventions have been described, these embodiments have been presented by way of example only, and are not intended to limit the scope of the disclosure. Indeed, the novel methods and systems described herein may be embodied in a variety of other forms. Furthermore, various omissions, substitutions and changes in the systems and methods described herein may be made without departing from the spirit of the disclosure. The accompanying claims and their equivalents are intended to cover such forms or modifications as would fall within the scope and spirit of the disclosure. Accordingly, the scope of the present inventions is defined only by reference to the appended claims.

Features, materials, characteristics, or groups described in conjunction with a particular aspect, embodiment, or example are to be understood to be applicable to any other aspect, embodiment or example described in this section or elsewhere in this specification unless incompatible therewith. All of the features disclosed in this specification (including any accompanying claims, abstract and drawings), and/or all of the steps of any method or process so disclosed, may be combined in any combination, except combinations where at least some of such features and/or steps are mutually exclusive. The protection is not restricted to the details of any foregoing embodiments. The protection extends to any novel one, or any novel combination, of the features disclosed in this specification (including any accompanying claims, abstract and drawings), or to any novel one, or any novel combination, of the steps of any method or process so disclosed.

Furthermore, certain features that are described in this disclosure in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations, one or more features from a claimed combination can, in some cases, be excised from the combination, and the combination may be claimed as a subcombination or variation of a sub combination.

Moreover, while operations may be depicted in the drawings or described in the specification in a particular order, such operations need not be performed in the particular order shown or in sequential order, or that all operations be performed, to achieve desirable results. Other operations that are not depicted or described can be incorporated in the example methods and processes. For example, one or more additional operations can be performed before, after, simultaneously, or between any of the described operations. Further, the operations may be rearranged or reordered in other implementations. Those skilled in the art will appreciate that in some embodiments, the actual steps taken in the processes illustrated and/or disclosed may differ from those shown in the figures. Depending on the embodiment, certain of the steps described above may be removed, others may be added. Furthermore, the features and attributes of the specific embodiments disclosed above may be combined in different ways to form additional embodiments, all of which fall within the scope of the present disclosure. Also, the separation of various system components in the implementations described above should not be understood as requiring such separation in all implementations, and it should be understood that the described components and systems can generally be integrated together in a single product or packaged into multiple products.

For purposes of this disclosure, certain aspects, advantages, and novel features are described herein. Not necessarily all such advantages may be achieved in accordance with any particular embodiment. Thus, for example, those skilled in the art will recognize that the disclosure may be embodied or carried out in a manner that achieves one advantage or a group of advantages as taught herein without necessarily achieving other advantages as may be taught or suggested herein.

Conditional language, such as "can," "could," "might," or "may," unless specifically stated otherwise, or otherwise understood within the context as used, is generally intended to convey that certain embodiments include, while other embodiments do not include, certain features, elements, and/or steps. Thus, such conditional language is not generally intended to imply that features, elements, and/or steps are in any way required for one or more embodiments or that one or more embodiments necessarily include logic for deciding, with or without user input or prompting, whether these features, elements, and/or steps are included or are to be performed in any particular embodiment.

Conjunctive language such as the phrase "at least one of X, Y, and Z," unless specifically stated otherwise, is otherwise understood with the context as used in general to convey that an item, term, etc. may be either X, Y, or Z. Thus, such conjunctive language is not generally intended to imply that certain embodiments require the presence of at least one of X, at least one of Y, and at least one of Z.

Language of degree used herein, such as the terms "approximately," "about," "generally," and "substantially" as used herein represent a value, amount, or characteristic close to the stated value, amount, or characteristic that still performs a desired function or achieves a desired result. For example, the terms "approximately", "about", "generally," and "substantially" may refer to an amount that is within less than 10% of, within less than 5% of, within less than 1% of, within less than 0.1% of, and within less than 0.01% of the stated amount. As another example, in certain embodiments, the terms "generally parallel" and "substantially parallel" refer to a value, amount, or characteristic that departs from exactly parallel by less than or equal to 15 degrees, 10 degrees, 5 degrees, 3 degrees, 1 degree, or 0.1 degree.

The scope of the present disclosure is not intended to be limited by the specific disclosures of preferred embodiments in this section or elsewhere in this specification, and may be defined by claims as presented in this section or elsewhere in this specification or as presented in the future. The language of the claims is to be interpreted broadly based on the language employed in the claims and not limited to the examples described in the present specification or during the prosecution of the application, which examples are to be construed as non-exclusive.

What is claimed is:

1. A swaddle wrap, comprising: a first portion having a backing layer, a front layer, and a first pouch formed between the backing layer and the front layer; and a second portion coupled with the first portion, the second portion having a backing layer, a front layer, and a second pouch formed between the backing layer and the front layer of the second portion; wherein: the swaddle wrap is configured to be moved from a first state to a second state; the first pouch is configured to receive therein at least both feet of a baby in the first and the second state; the second pouch is configured to receive therein at least both feet of the baby and a portion of the first portion of the swaddle wrap in the second state; the second portion is configured to extend around at least the baby's feet in the second state to secure the swaddle wrap to the baby's body.

2. The swaddle wrap of claim 1, wherein the second portion is configured to be extended around at least one of the baby's shoulders and both feet of the baby.

3. The swaddle wrap of claim 1, wherein an opening of the first portion faces an opening of the second portion in the second state.

4. The swaddle wrap of claim 1, wherein the first portion is configured to cover a first shoulder of the baby when the baby is in the first pouch in the second state so that a portion of the first portion is positioned over the top of and around the baby's first shoulder in the second state.

5. The swaddle wrap of claim 4, wherein the first portion is configured to not cover a second shoulder of the baby when the baby is in the first pouch in the second state.

6. The swaddle wrap of claim 1, wherein the second portion is configured to cover a second shoulder of the baby in the second state so that a portion of the second portion is positioned over the top of the baby's second shoulder and around the baby's second shoulder in the second state.

7. The swaddle wrap of claim 1, wherein the swaddle wrap is configured such that no portion of the swaddle wrap goes over the baby's head during the process of covering the baby with the swaddle wrap.

8. The swaddle wrap of claim 1, wherein the backing layer of the second portion is configured to directly contact and overlap at least a portion of the first portion.

9. The swaddle wrap of claim 1, wherein the first portion and the second portion form a crisscross pattern over a front of the baby's body in the second state such that an edge of an opening of the first pouch extends across the baby's body in a first diagonal direction and such that an edge of an opening of the second pouch extends across the baby's body in a second diagonal direction at an angle that is acute with the edge of the opening of the first pouch.

10. The swaddle wrap of claim 1, wherein the swaddle wrap is configured to be secured to the baby without a use of zippers, snaps, ties, hook and loop fasteners, buttons, knots, magnets or other connectors or fasteners other than the first and second pouches.

11. The swaddle wrap of claim 1, wherein the swaddle wrap is configured to be secured to the baby's body using only the first pouch and the second pouch.

12. The swaddle wrap of claim 1, wherein the swaddle wrap is configured to change from the first state in which no portion of the baby's body is covered by the swaddle wrap to the second state in which the baby's body from at least the arms down is completely covered by the swaddle wrap and the swaddle wrap is secured to the baby's body in only two steps.

13. The swaddle wrap of claim 12, wherein a first step of the two steps comprises positioning the baby in the first pouch so that at least both of the baby's feet and one of the baby's shoulders are in the first pouch.

14. The swaddle wrap of claim 12, wherein a second step of the two steps comprises positioning the second portion over at least a portion of the baby so that at least both of the baby's feet and one of the baby's shoulders are covered by the backing layer of the second portion and so that at least both of the babies feet are positioned in the second pouch.

15. The swaddle wrap of claim 1, further comprising a third portion, wherein the third portion is configured to extend around at least the feet of the baby in a second state to secure the third portion to the baby's body in the second state.

16. A method of securing a swaddle wrap to a baby, comprising: at least partially covering the baby with the first portion of the swaddle wrap of claim 1; positioning at least both feet of the baby within the first pouch of the first portion of the swaddle wrap; at least partially covering the baby with the second portion of the swaddle wrap; and covering at least one of the baby's shoulders with the second portion of the swaddle wrap and extending the second pouch over at least the baby's feet and a portion of the first pouch of the first portion of the swaddle wrap so that at least both feet of the baby and a portion of the first pouch of the first portion of the swaddle wrap are positioned within the second pouch of the swaddle wrap.

17. A swaddle wrap, comprising: a first portion having a backing layer, a front layer, and a first pouch formed between the backing layer and the front layer; and a second portion coupled with the first portion, the second portion having a backing layer, a front layer, and a second pouch formed between the backing layer and the front layer of the second portion; wherein: the swaddle wrap is configured to be moved from a first state to a second state; the first pouch is configured to receive therein at least both feet of a baby in the first and the second state; the second pouch is configured to receive therein at least both feet of the baby and a portion of the first portion of the swaddle wrap in the second state; and the swaddle wrap is configured to be secured to the baby without a use of zippers, snaps, ties, hook and loop fasteners, buttons, knots, magnets or other connectors or fasteners other than the first and second pouches.

18. The swaddle wrap of claim 17, wherein the first portion is configured to cover a first shoulder of the baby when the baby is in the first pouch in the second state so that a portion of the first portion is positioned over the top of and around the baby's first shoulder in the second state.

19. The swaddle wrap of claim 17, wherein the swaddle wrap is configured such that no portion of the swaddle wrap goes over the baby's head during the process of covering the baby with the swaddle wrap.

20. The swaddle wrap of claim 17, wherein the backing layer of the second portion is configured to directly contact and overlap at least a portion of the first portion.

21. The swaddle wrap of claim 17, wherein the first portion and the second portion form a crisscross pattern over a front of the baby's body in the second state such that an edge of an opening of the first pouch extends across the baby's body in a first diagonal direction and such that an edge of an opening of the second pouch extends across the baby's body in a second diagonal direction at an angle that is acute with the edge of the opening of the first pouch.

22. The swaddle wrap of claim 17, wherein the swaddle wrap is configured to be secured to the baby's body using only the first pouch and the second pouch.

23. The swaddle wrap of claim 17, wherein the swaddle wrap is configured to change from the first state in which no portion of the baby's body is covered by the swaddle wrap to the second state in which the baby's body from at least the arms down is completely covered by the swaddle wrap and the swaddle wrap is secured to the baby's body in only two steps.

24. The swaddle wrap of claim 23, wherein a first step of the two steps comprises positioning the baby in the first pouch so that at least both of the baby's feet and one of the baby's shoulders are in the first pouch.

25. The swaddle wrap of claim 23, wherein a second step of the two steps comprises positioning the second portion over at least a portion of the baby so that at least both of the baby's feet and one of the baby's shoulders are covered by the backing layer of the second portion and so that at least both of the babies feet are positioned in the second pouch.

26. A swaddle wrap, comprising: a first portion having a backing layer, a front layer, and a first pouch formed between the backing layer and the front layer; and a second portion coupled with the first portion, the second portion having a backing layer, a front layer, and a second pouch formed between the backing layer and the front layer of the second portion; wherein: the swaddle wrap is configured to be moved from a first state to a second state; the first pouch is configured to receive therein at least both feet of a baby in the first and the second state; the second pouch is configured to receive therein at least both feet of the baby and a portion of the first portion of the swaddle wrap in the second state; and the swaddle wrap is configured to be secured to the baby's body using only the first pouch and the second pouch.

27. The swaddle wrap of claim 26, wherein the first portion is configured to cover a first shoulder of the baby when the baby is in the first pouch in the second state so that a portion of the first portion is positioned over the top of and around the baby's first shoulder in the second state.

28. The swaddle wrap of claim 26, wherein the swaddle wrap is configured such that no portion of the swaddle wrap goes over the baby's head during the process of covering the baby with the swaddle wrap.

29. The swaddle wrap of claim 26, wherein the backing layer of the second portion is configured to directly contact and overlap at least a portion of the first portion.

30. The swaddle wrap of claim 26, wherein the first portion and the second portion form a crisscross pattern over a front of the baby's body in the second state such that an edge of an opening of the first pouch extends across the baby's body in a first diagonal direction and such that an edge of an opening of the second pouch extends across the baby's body in a second diagonal direction at an angle that is acute with the edge of the opening of the first pouch.

* * * * *